US007097529B2

(12) United States Patent
Horiuchi et al.

(10) Patent No.: US 7,097,529 B2
(45) Date of Patent: Aug. 29, 2006

(54) METHOD FOR PRODUCING A HIGH PRESSURE DISCHARGE LAMP, WITH SEALING PORTION HAVING FIRST AND SECOND GLASS MEMBERS

(75) Inventors: Makoto Horiuchi, Nara (JP); Kiyoshi Takahashi, Kyoto (JP); Tsuyoshi Ichibakase, Osaka (JP); Shinichiro Hataoka, Osaka (JP); Tomoyuki Seki, Osaka (JP); Takashi Tsutatani, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 233 days.

(21) Appl. No.: 10/744,674

(22) Filed: Dec. 22, 2003

(65) Prior Publication Data

US 2004/0135514 A1 Jul. 15, 2004

(30) Foreign Application Priority Data

Jan. 14, 2003 (JP) ..... 2003-006144

(51) Int. Cl.
*H01J 9/00* (2006.01)

(52) U.S. Cl. ..... 445/26; 445/22; 445/43; 313/634; 313/579

(58) Field of Classification Search ..... 445/22, 445/26, 27, 43; 313/623, 634, 579
See application file for complete search history.

(56) References Cited

U.S. PATENT DOCUMENTS 4,550,269 A * 10/1985 Dixon ..... 313/331
4,823,050 A * 4/1989 English et al. ..... 313/634
5,109,181 A 4/1992 Fischer et al. ..... 313/571
5,468,168 A * 11/1995 Balaschak et al. ..... 445/26
5,598,063 A * 1/1997 Mathews et al. ..... 313/623
6,137,228 A * 10/2000 Aizawa et al. ..... 313/631
6,232,719 B1 5/2001 Kaneko et al. ..... 313/625
6,271,628 B1 * 8/2001 Sugitani et al. ..... 313/637
6,890,236 B1 * 5/2005 Hataoka et al. ..... 445/26

FOREIGN PATENT DOCUMENTS

| | | |
|---|---|---|
| EP | 1 225 614 A1 | 7/2002 |
| JP | 2-148561 | 6/1990 |
| JP | 4-229942 | 8/1992 |
| JP | 2001-23570 | 1/2001 |

* cited by examiner

*Primary Examiner*—Karabi Guharay
*Assistant Examiner*—Kevin Quaterman
(74) *Attorney, Agent, or Firm*—Harness, Dickey & Pierce, P.L.C.

(57) ABSTRACT

A glass pipe 80 for a discharge lamp is prepared which includes a luminous bulb portion 1' that will be formed into a luminous bulb of a high pressure discharge lamp and a side tube portion 2'. Subsequently, a glass member 70 made of a second glass having a softening point lower than that of a first glass constituting the side tube portion 2' is inserted into the side tube portion 2', after which a getter 75 is disposed in the side tube portion 2'. Then, with the pressure inside the glass pipe 80 reduced, the side tube portion 2' is heated to tightly attach the glass member 70 to the side tube portion 2', thereby forming a sealing portion.

16 Claims, 22 Drawing Sheets

Compressive stress remains

METHOD FOR PRODUCING A HIGH PRESSURE DISCHARGE LAMP, WITH SEALING PORTION HAVING FIRST AND SECOND GLASS MEMBERS

BACKGROUND OF THE INVENTION

1. Field of the Invention

The present invention relates to methods for producing a high pressure discharge lamp, and to lamp members for a high pressure discharge lamp which are used to produce a high pressure discharge lamp. In particular, the present invention relates to methods for producing a high pressure discharge lamp used for general illumination, a projector or an automobile headlight in combination with a reflecting mirror, or the like.

2. Description of the Related Art

In recent years, an image projecting apparatus such as a liquid crystal projector and a DMD (Digital Micromirror Device) projector has been commonly used as a system for realizing large-scale video images, and in general, a high pressure discharge lamp having a high intensity has been commonly used for such an image projecting apparatus. FIG. 17 is a schematic view showing the structure of a conventional high pressure discharge lamp 1000. The lamp 1000 shown in FIG. 17 is a so-called ultrahigh pressure mercury lamp, which is disclosed, for example, in Japanese Unexamined Patent Publication No. 2-148561.

The lamp 1000 includes a luminous bulb (arc tube) 101 made of quartz glass and a pair of sealing portions (seal portions) 102 extending from both ends of the luminous bulb 101. A luminous material (mercury) 106 is enclosed inside (in a discharge space) of the luminous bulb 101, and a pair of tungsten electrodes (W electrodes) 103 made of tungsten are opposed with a predetermined distance. A molybdenum foil (Mo foil) 104 in the sealing portion 102 is welded to one end of the W electrode 103, and the W electrode 103 and the Mo foil 104 are electrically connected to each other. An external lead (Mo rod) 105 made of molybdenum is electrically connected to one end of the Mo foil 104. Argon (Ar) and a small amount of halogen, in addition to the mercury 106, are enclosed in the luminous bulb 101.

The operational principle of the lamp 1000 will be briefly described below. When a start voltage is applied between the W electrodes 103 via the external leads 105 and the Mo foils 104, discharge of argon (Ar) occurs. This discharge increases the temperature in the discharge space of the luminous bulb 101, and then the mercury 106 is heated and evaporated. Therefore, mercury atoms are exited in the central portion of an arc between the W electrodes 103 and thus light is emitted. The higher the mercury vapor pressure of the lamp 1000 is, the more light is radiated, so that the lamp with a higher mercury vapor pressure is more suitable for the light source of an image projecting apparatus. However, in view of the physical strength of the luminous bulb 101 against pressure, the lamp 1000 is used at a mercury vapor pressure of 15 to 20 MPa (150 to 200 atm).

SUMMARY OF THE INVENTION

The conventional lamp 1000 described above has a strength against a pressure of about 20 MPa. In order to further improve the lamp characteristics, research and development aiming to further enhance the lamp strength against pressure is conducted (e.g., see Japanese Unexamined Patent Publication No.2001-23570). This is because there is a demand for a higher output and power lamp to realize a higher performance image projecting apparatus, and thus there is a demand for a lamp having a higher strength against pressure in order to meet this demand.

Further describing this point, in the case of a high output and power lamp, in order to suppress a rapid evaporation of the electrodes by an increase in current, it is necessary to enclose a higher amount of mercury than usual to increase the lamp voltage. If the amount of mercury enclosed is insufficient relatively to the lamp power, the lamp voltage cannot be increased to a necessary level, resulting in a lamp current increase. As a result, the electrodes are evaporated in a short time, and therefore a practical lamp cannot be achieved. In other words, what should be done in order to realize a high power lamp is only to increase the lamp power and to produce a short-arc type lamp whose interelectrode distance is shorter than that of a conventional lamp. However, in order to produce a high output and high power lamp in practice, it is necessary to improve the strength against pressure to increase the amount of mercury enclosed. Current techniques have not succeeded in realizing a high pressure discharge lamp having a very high strength against pressure (e.g., about 30 MPa or more) that can be used in practice.

The inventors successfully developed a high pressure discharge lamp having an extremely high strength against pressure (e.g., about 30 MPa or more) as disclosed in Japanese Patent Application No.2002-351524. However, the inventors have found that even such an excellent lamp can be further improved by modifying a producing method thereof.

Therefore, with the foregoing in mind, it is a main object of the present invention to provide a more effective method for producing a high pressure discharge lamp having high strength against pressure. Another object of the present invention is to provide a lamp member for a high pressure discharge lamp which can preferably be used for this production method.

A method for producing a high pressure discharge lamp of the present invention is designed for a high pressure discharge lamp comprising a luminous bulb enclosing a luminous substance inside and a sealing portion for retaining the airtightness of the luminous bulb. This method comprises the steps of: preparing a glass pipe for a discharge lamp including a luminous bulb portion that will be formed into a luminous bulb of a high pressure discharge lamp and a side tube portion extending from the luminous bulb portion; inserting, into the side tube portion, a glass member made of a second glass having a softening point lower than that of a first glass constituting the side tube portion; disposing a getter in the side tube portion; and heating the side tube portion with the pressure inside the glass pipe reduced to tightly attach the glass member to the side tube portion, thereby forming the sealing portion.

In one preferred embodiment, this method further comprises the step of heating, after the attachment step, a portion including at least the glass member and the side tube portion at a temperature higher than the strain point temperature of the second glass.

It is preferable that the heating step is performed at a temperature lower than the strain point temperature of the first glass.

In one preferred embodiment, the glass member is a glass tube or a glass plate formed of $SiO_2$ and at least one of 15 wt % or less of $Al_2O_3$ and 4 wt % or less of B.

Another method for producing a high pressure discharge lamp of the present invention is designed for a high pressure discharge lamp comprising a luminous bulb enclosing a luminous substance inside and a pair of sealing portions extending from both ends of the luminous bulb. This method comprises the steps of: preparing a glass pipe for a discharge lamp including a luminous bulb portion that will be formed into a luminous bulb of a high pressure discharge lamp and a pair of side tube portions extending from both ends of the luminous bulb portion; inserting, into one of the pair of side tube portions, a glass tube made of a second glass having a softening point lower than that of a first glass constituting the side tube portion and an electrode structure including at least an electrode rod, and then shrinking one said side tube portion by heating to form one of the pair of sealing portions; introducing a luminous substance and halogen precursor to be decomposed into halogen into the luminous bulb portion after one said sealing portion is formed; inserting a glass tube made of the second glass and an electrode structure including at least an electrode rod into the other of the pair of side tube portions; disposing a getter in the other said side tube portion; shrinking the other said side tube portion by heating with the pressure inside the glass pipe reduced to form the other of the pair of sealing portions; and heating a portion of a lamp assembly resulting from the formation of both the sealing portions and the luminous bulb at a temperature higher than the strain point temperature of the second glass and lower than the strain point temperature of the first glass, the portion of the lamp assembly including at least the glass tube and the side tube portion.

In one preferred embodiment, the step of forming the other sealing portion includes the substep of cutting off and removing an unnecessary portion of the other said side tube portion after the other said side tube portion is shrunk by heating, and the unnecessary portion of the other said side tube portion contains the getter and the getter is removed when the unnecessary portion is cut and removed.

In one preferred embodiment, the electrode structure includes the electrode rod, a metal foil connected to the electrode rod, and an external lead connected to the metal foil. A supporting member for supporting the electrode structure is connected to a portion of the external lead. When the glass tube and the electrode structure are inserted into one or the other said side tube portion, the electrode structure is disposed in one or the other said side tube portion so that the glass tube is placed around at least a portion of the electrode structure, and the head of the electrode rod of the electrode structure is disposed to be present in the luminous bulb portion. In the step of disposing a getter in the other said side tube portion, when the side of the other said side tube portion closer to the luminous bulb portion is assumed to be the front, the getter is disposed at the back of the supporting member of the electrode structure. The step of activating the getter by heating is performed during the time when the pressure inside the glass pipe is reduced. The step of forming the other sealing portion includes the substep of cutting off and removing an unnecessary portion of the other said side tube portion after the other said side tube portion is shrunk by heating. The unnecessary portion of the other said side tube portion contains the getter. In the cutting and removing substep, the other said side tube portion is cut such that a portion of the external lead is cut off, thereby removing the getter.

In one preferred embodiment, the halogen precursor is mercuric bromide ($HgBr_2$).

It is preferable that the heating step is performed for 2 hours or more.

In one preferred embodiment, the heating step is performed for 100 hours or more.

In one preferred embodiment, the heating step is performed so that when the sealing portion is measured by a sensitive color plate method utilizing a photoelastic effect, a compressive stress of from 10 kgf/cm$^2$ to 50 kgf/cm$^2$ inclusive in the longitudinal direction of the side tube portion is present in a region of the sealing portion made of the second glass.

In one preferred embodiment, the compressive stress is generated in each of the pair of sealing portions.

In one preferred embodiment, the first glass contains 99 wt % or more of $SiO_2$, and the second glass contains $SiO_2$ and at least one of 15 wt % or less of $Al_2O_3$ and 4 wt % or less of B.

In one preferred embodiment, the temperature of the heating is 1030° C.±40° C.

In one preferred embodiment, the high pressure discharge lamp is a high pressure mercury lamp, and the high pressure discharge lamp encloses, as the luminous substance, mercury in an amount of 150 mg/cm$^3$ or more based on the internal volume of the luminous bulb.

A lamp member for a high pressure discharge lamp of the present invention comprises: a glass pipe for a discharge lamp including a luminous bulb portion that will be formed into a luminous bulb of a high pressure discharge lamp and a side tube portion extending from the luminous bulb portion; a glass member which is disposed in the side tube portion and which is made of a second glass having a softening point lower than that of a first glass constituting the side tube portion; an electrode structure which is disposed in the side tube portion and which includes at least an electrode rod; and a getter disposed in the side tube portion.

Another lamp member for a high pressure discharge lamp of the present invention is used to produce a high pressure discharge lamp comprising a luminous bulb enclosing a luminous substance inside and a pair of sealing portions extending from both ends of the luminous bulb. This lamp member comprises: a glass pipe for a discharge lamp including a luminous bulb portion that will be formed into a luminous bulb of a high pressure discharge lamp and a pair of side tube portions extending from both ends of the luminous bulb portion; one of the sealing portions formed by shrinking one of the pair of side tube portions; and a getter disposed in the other of the side tube portions. One said sealing portion includes a first glass constituting one said side tube portion, a second glass having a softening point lower than that of the first glass, and an electrode structure with an electrode rod. The electrode structure of one said sealing portion includes the electrode rod, a metal foil connected to the electrode rod, and an external lead connected to the metal foil, and the second glass covers all sides of at least a portion of the metal foil. A glass tube made of the second glass having a softening point lower than that of the first glass constituting the other said side tube portion and an electrode structure including an electrode rod are disposed in the other said side tube portion. The electrode structure disposed in the other said side tube portion includes the electrode rod, a metal foil connected to the electrode rod, and an external lead connected to the metal foil, and the glass tube is placed around at least a portion of the metal foil. When the side of the other said side tube portion closer to the head of the electrode rod is assumed to be the front, the getter is disposed at the back of the metal foil in the other said side tube portion.

In one preferred embodiment, mercuric bromide ($HgBr_2$) is contained in the luminous bulb portion.

In one embodiment, the lamp member for a high pressure discharge lamp is a lamp member for a high pressure mercury lamp, and the lamp member encloses, as the luminous substance, mercury in an amount of 150 mg/cm$^3$ or more based on the internal volume of the luminous bulb.

In one preferred embodiment, mercury is enclosed as the luminous substance in an amount of 220 mg/cm$^3$ or more based on the internal volume of the luminous bulb.

In one preferred embodiment, mercury is enclosed as the luminous substance in an amount of 300 mg/cm$^3$ or more based on the internal volume of the luminous bulb.

In one embodiment, the electrode structure includes the electrode rod, a metal foil connected to the electrode rod, and an external lead connected to the metal foil.

It is preferable that a metal film made of at least one metal selected from the group consisting of platinum (Pt), iridium (Ir), rhodium (Rh), ruthenium (Ru), and rhenium (Re) is formed at least in a portion of the electrode rod.

In one embodiment, a coil having, at least on its surface, at least one metal selected from the group consisting of Pt, Ir, Rh, Ru, and Re is wound around at least in a portion of the electrode rod.

In one embodiment, a portion having a small diameter in which an inner diameter of the side tube portion is smaller than that of other portions is provided in a vicinity of a boundary of the side tube portion and the luminous bulb portion in the glass pipe for a discharge lamp.

A high pressure discharge lamp in one embodiment comprises: a luminous bulb enclosing a luminous substance inside; and a sealing portion for retaining the airtightness of the luminous bulb. The sealing portion has a first glass portion extending from the luminous bulb and a second glass portion provided at least in a portion of the inside of the first glass portion. The sealing portion further has a portion to which a compressive stress is applied.

A high pressure discharge lamp in one embodiment includes a luminous bulb enclosing a luminous substance therein; and a sealing portion for retaining the airtightness of the luminous bulb. The sealing portion has a first glass portion extending from the luminous bulb and a second glass portion provided at least in a portion of the inside of the first glass portion. When a strain measurement is performed by a sensitive color plate method utilizing a photoelastic effect is performed, a compressive stress is observed at least in a portion of a region of the sealing portion corresponding to the second glass portion.

In one preferred embodiment, the luminous bulb is tipless.

The strain measurement can be performed with a strain detector of SVP-200 manufactured by Toshiba Cooperation.

In one embodiment, only $H_2$ gas of 0.009 kPa or less and $H_2O$ gas of 0.001 kPa or less exist inside the sealing portion of the high pressure discharge lamp.

A lamp unit in one embodiment comprises the high pressure discharge lamp and a reflecting mirror for reflecting light emitted from the high pressure discharge lamp.

With the method for producing a high pressure discharge lamp according to the present invention, a getter is disposed in a side tube portion. Therefore, even though a glass member is inserted into the side tube portion, residual gas can be removed sufficiently in a pressure-reduction step of a glass pipe for a discharge lamp. Consequently, this contributes to an efficient performance of the pressure-reduction step and suppression of the occurrence of bubbles in the sealing portion.

DETAILED DESCRIPTION OF THE PREFERRED EMBODIMENTS

Prior to description of embodiments of the present invention, a description will first be made of high pressure mercury lamps with an extremely high strength against pressure which have an operation pressure of about 30 to 40 MPa or higher (about 300 to 400 atm or higher). Note that the details of these high pressure mercury lamps as well as the mechanism by which strain is created in a sealing portion of the lamp are disclosed in U.S. Patent Application Publication No. 2003/0168980 A1, the contents of which are incorporated herein by reference.

Figure 1A:
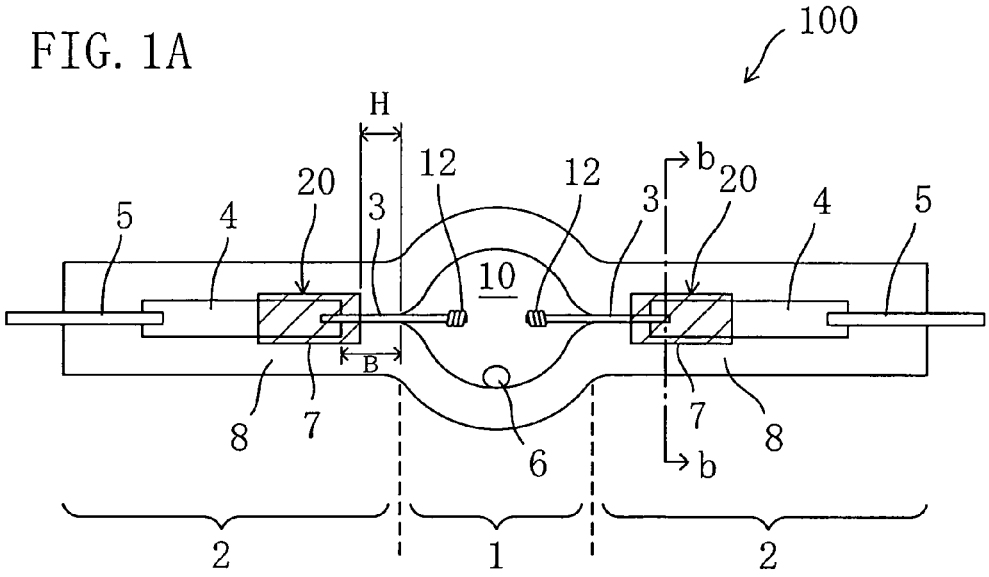
FIGS. 1A and 1B are schematic cross-sectional views showing the structure of a high pressure discharge lamp 100.
Figure 1B:
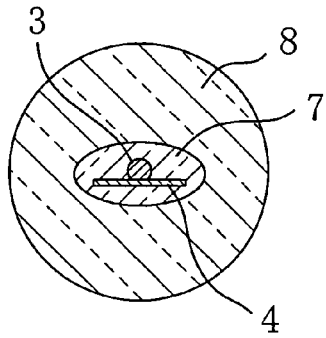

It was very tough work to develop a practically usable high pressure mercury lamp even with an operation pressure of about 30 MPa or higher. However, for example, by applying a structure shown in FIG. 1 to the lamp, the inventors successfully attained a lamp with extremely high withstand pressure. FIG. 1B is a cross-sectional view take along the line b—b of FIG. 1A.

A high pressure discharge lamp (for example, a high or ultrahigh pressure mercury lamp) 100 shown in FIG. 1 is disclosed in U.S Patent Application Publication No. 2003/0168980 A1. The lamp 100 includes a luminous bulb 1 and a pair of sealing portions 2 for retaining the airtightness of the luminous bulb 1. At least one of the sealing portions 2 includes a first glass portion 8 extending from the luminous bulb 1 and a second glass portion 7 provided at least in a portion of the inside of the first glass portion 8. One said sealing portion 2 has a portion (20) to which a compressive stress is applied.

The compressive stress applied to a portion of the sealing portion 2 can be substantially beyond zero (i.e., 0 kgf/cm$^2$). The presence of the compressive stress can improve the strength against pressure as compared to the conventional structure. It is preferable that the compressive stress is about 10 kgf/cm$^2$ or more, (about $9.8\times10^5$ N/m$^2$ or more) and about 50 kgf/cm$^2$ or less, (about $4.9\times10^6$ N/m$^2$ or less). When it is less than 10 kgf/cm$^2$, the compressive strain is so weak that the strength of the lamp against pressure may not be increased sufficiently. Moreover, there is no practical glass material that can realize a structure having a compressive stress higher than about 50 kgf/cm$^2$. However, a compressive stress of less than 10 kgf/cm$^2$ can increase the strength against pressure as compared to the conventional structure as long as it exceeds substantially zero. If a practical material that can realize a structure having a compressive stress of more than 50 kgf/cm$^2$ is developed, the second glass portion 7 can have a compressive stress of more than 50 kgf/cm$^2$.

The first glass portion 8 in the sealing portion 2 contains 99 wt % or more of silica ($SiO_2$), and is made of, for example, quartz glass. On the other hand, the second glass portion 7 contains $SiO_2$ and at least one of 15 wt % or less of alumina ($Al_2O_3$) and 4 wt % or less of boron (B), and is made of, for example, Vycor glass. When $Al_2O_3$ or B is added to $SiO_2$, the glass softening point is decreased. Therefore, the softening point of the second glass portion 7 is lower than that of the first glass portion 8. As can be seen, the total amount of $Al_2O_3$ and B contained in the second glass portion 7 is preferably more than 1 wt % to decrease the softening point of the second glass portion 7. The Vycor glass (product name) is glass obtained by mixing additives in quartz glass to decrease the softening point so as to improve the processability of quartz glass. For example, the Vycor glass can be produced by subjecting borosilicate glass to a thermal and chemical treatment to have the characteristics similar to those of quartz. An exemplary composition of the Vycor glass is as follows: 96.5 wt % of silica ($SiO_2$); 0.5 wt % of alumina ($Al_2O_3$); and 3 wt % of boron (B). In this embodiment, the second glass portion 7 is formed of a glass tube made of Vycor glass. The glass tube made of Vycor glass can be replaced by a glass tube containing 62 wt % of $SiO_2$, 13.8 wt % of $Al_2O_3$, and 23.7 wt % of CuO.

An electrode rod 3 one end of which is positioned in the discharge space is connected by welding to a metal foil 4 provided in the sealing portion 2, and at least a part of the metal foil 4 is positioned in the second glass portion 7. In the structure shown in FIG. 1, a portion including a connection portion of the electrode rod 3 with the metal foil 4 is covered with the second glass portion 7. As shown in FIG. 1B, in a transverse cross section of the sealing portion 2 (a cross section of the sealing portion 2 intersecting perpendicularly to the longitudinal direction thereof), all sides of the metal foil 4 are covered with the second glass portion 7. Thus, all sides of at least a portion of the metal foil 4 when viewed in its transverse cross section are covered with the second glass portion 7. In this portion, all edges of the metal foil 4 are covered with the second glass portion 7. Exemplary sizes of the second glass portion 7 in the structure shown in FIG. 1 are as follows. The length of the sealing portion 2 in the longitudinal direction is about 2 to 20 mm (e.g., 3 mm, 5 mm or 7 mm), and the thickness of the second glass portion 7 interposed between the first glass portion 8 and the metal foil 4 is about 0.01 to 2 mm (e.g., 0.1 mm). The distance H from the end face of the second glass portion 7 on the side of the luminous bulb 1 to the discharge space 10 of the luminous bulb 1 is about 0 mm to about 6 mm (e.g., 0 mm to about 3 mm or 1 mm to 6 mm). When the second glass portion 7 is not desired to be exposed into the discharge space 10, the distance H is larger than 0 mm, and for example, 1 mm or more. The distance B from the end face of the metal foil 4 on the side of luminous bulb 1 to the discharge space 10 of the luminous bulb 1 (in other words, the length of the portion of the electrode rod 3 that is buried alone in the sealing portion 2) is, for example, about 3 mm.

Figure 2A:
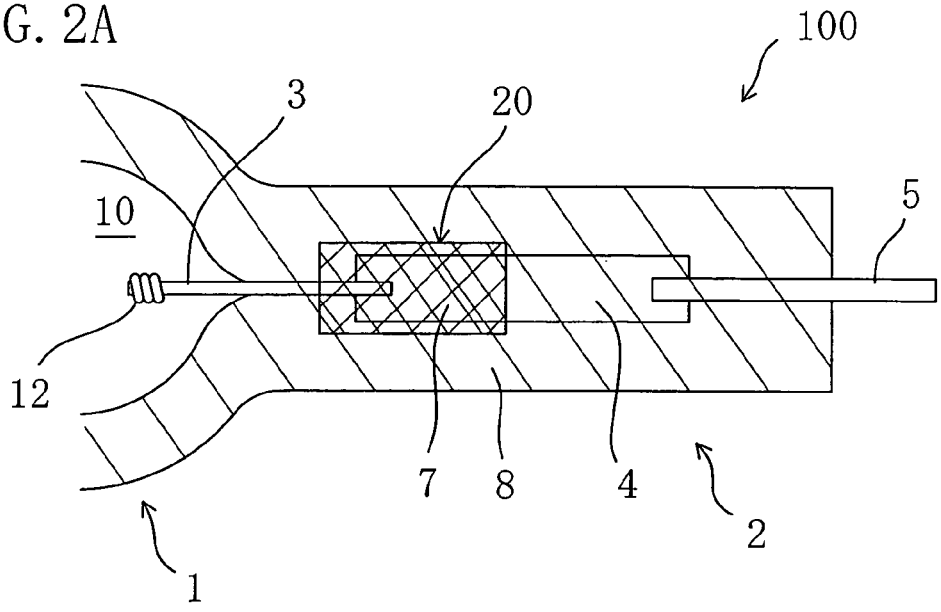
FIGS. 2A and 2B are enlarged views of the principal part schematically showing the distribution of compressive strain along the longitudinal direction (electrode axis direction) of a sealing portion 2.
Figure 2B:
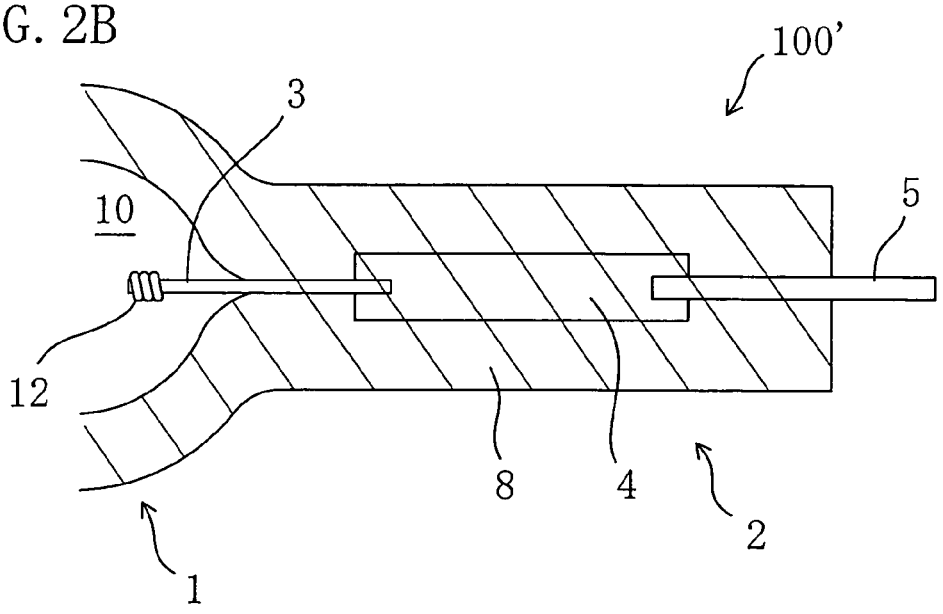

Next, the compressive strain in the sealing portion 2 will be described. FIGS. 2A and 2B are schematic views showing the distribution of the compressive strain along the longitudinal direction (direction of the electrode axis) of the sealing portion 2. FIG. 2A shows the distribution in the structure of the lamp 100 provided with the second glass portion 7, and FIG. 2B shows the distribution in the structure of the lamp 100' that is not provided with the second glass portion 7 (comparative example).

In the sealing portion 2 shown in FIG. 2A, a compressive stress (compressive strain) is present in a region (cross-hatched region) corresponding to the second glass portion 7, and the magnitude of compressive stress in the portion (hatched region) of the first glass portion 8 is substantially zero. On the other hand, as shown in FIG. 2B, in the case of the sealing portion 2 not provided with the second glass portion 7, there is no portion in which a compressive strain is locally present, and the magnitude of compressive stress on the first glass portion 8 is substantially zero.

The inventors actually measured the strain within the lamp 100 quantitatively, and observed that a compressive stress is present in the second glass portion 7 in the sealing portion 2. This quantification of the strain was performed using a sensitive color plate method utilizing photoelastic effect. A measuring device for quantifying a strain is a strain detector (SVP-200 manufactured by Toshiba Corporation), and when this strain detector is used, the magnitude of compressive strain on the sealing portion 2 can be obtained as an average of the stress applied to the sealing portion 2.

The principle of the strain measurement by the sensitive color plate method utilizing photoelastic effect will be described briefly with reference to FIG. 18. FIGS. 18A and 18B are schematic views showing the state in which linearly polarized light obtained by transmitting light through a polarizing plate is incident to glass. Herein, when the vibration direction of the linearly polarized light is taken as u, u can be regarded as being obtained by synthesizing u1 and u2.

Figure 18A:
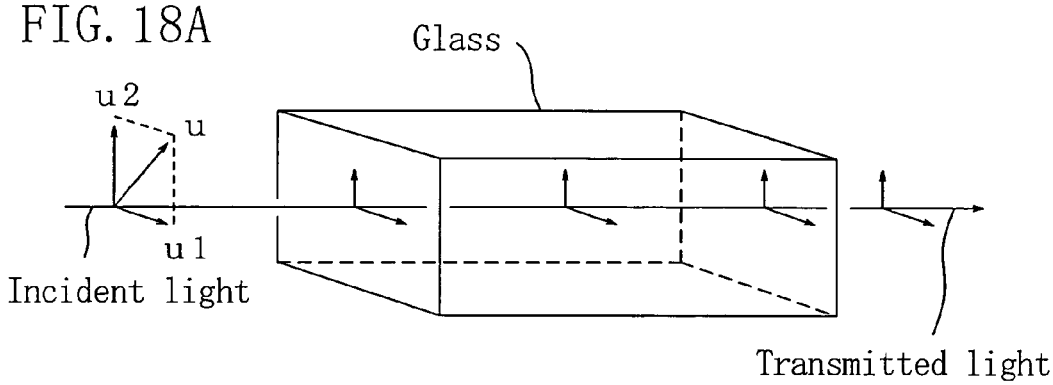
FIGS. 18A and 18B are drawings for explaining the principle of the measurement of strain by a sensitive color plate method utilizing photoelastic effect.
Figure 18B:
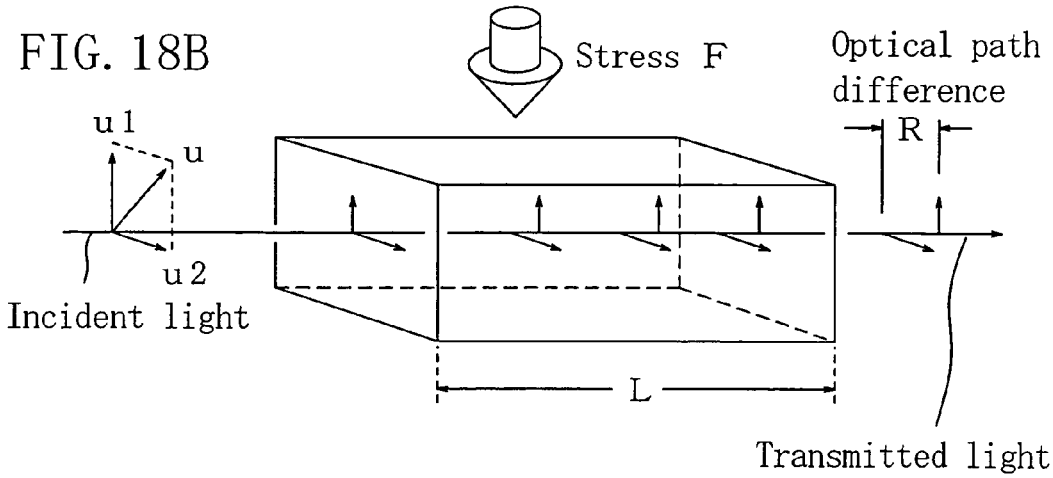

As shown in FIG. 18A, if there is no strain in the glass, u1 and u2 are transmitted through it at the same speed. Therefore, no displacement of the transmitted lights u1 and u2 occurs. On the other hand, as shown in FIG. 18B, if there is a strain in the glass and a stress F is applied thereto, u1 and u2 are not transmitted through it at the same speed, so that an offset of the transmitted lights u1 and u2 occurs. In other words, one of u1 and u2 is later than the other. The distance of this difference made by being late is referred to as an optical path difference. Since the optical path difference R is proportional to the stress F and the distance of light transmission through the glass L, the optical path difference R can be expressed as $$R=C\cdot F\cdot L$$

where C is a proportional constant. The unit of each letter is as follows: R (nm); F (kgf/cm$^2$); L (cm); and C ({nm/cm}/{kgf/cm$^2$}). C is referred to as "photoelastic constant" and depends on the materials used such as glass. As seen from the above equation, if C is known, L and R can be measured to obtain F.

The inventors measured the distance L of light transmission in the sealing portion 2, that is, the outer diameter L of the sealing portion 2, and obtained the optical path difference R by observing the color of the sealing portion 2 at the time of measurement with a strain standard. The photoelastic constant of quartz glass, which is 3.5, was used as the photoelastic constant C. These values were substituted in the above equation to calculate the stress value, and the compressive strain in the longitudinal direction of the metal foil 4 was quantified with the calculated stress value.

In this measurement, stress in the longitudinal direction (direction in which the electrode rod 3 extends) of the sealing portion 2 was observed, but this does not mean that there is no compressive stress in other directions. In order to determine whether or not a compressive stress is present in the radial direction (the direction from the central axis toward the outer circumference, or the opposite direction) or the circumferential direction (e.g., the clockwise direction) of the sealing portion 2, it is necessary to cut the luminous bulb 1 or the sealing portion 2. However, as soon as such cutting is performed, the compressive stress in the second glass portion 7 is released. Therefore, only the compressive stress in the longitudinal direction of the sealing portion 2 can be measured without cutting the lamp 100. Consequently, the inventors quantified the compressive stress at least in this direction.

In the lamp 100 of this embodiment, a compressive strain (at least compressive strain in the longitudinal direction) is present in the second glass portion 7 provided at least in a portion of the inside of the first glass portion 8, so that the strength against pressure of a high pressure discharge lamp can be improved. In other words, the lamp 100 of this embodiment shown in FIGS. 1 and 2A can have a higher strength against pressure than the comparative lamp 100' shown in FIG. 2B. It is possible to operate the lamp 100 of this embodiment shown in FIG. 1 at an operating pressure of 30 MPa or more, which is more than a highest level of the conventional lamps of about 20 MPa.

Figure 19A:
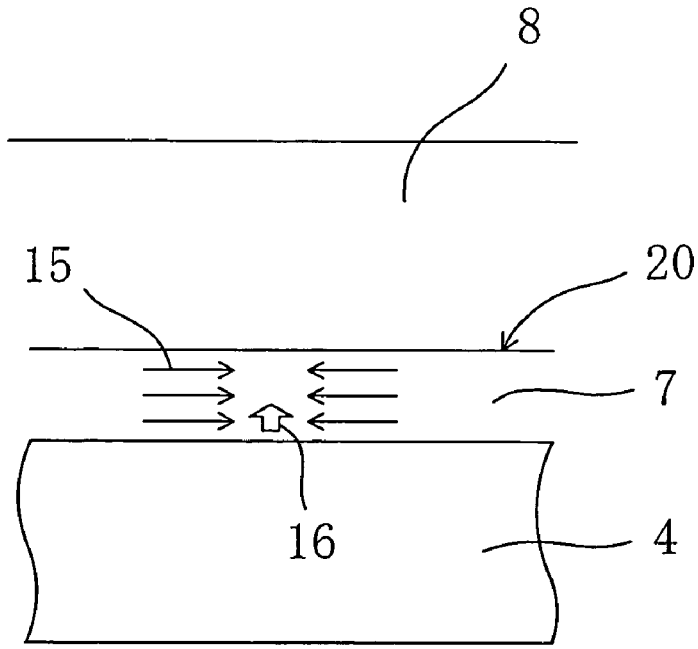
FIGS. 19A and 19B are enlarged views of the principal part of the lamp 100 for explaining the reason why the strength of the lamp 100 against pressure is increased by a compressive strain occurring in a second glass portion.
Figure 19B:
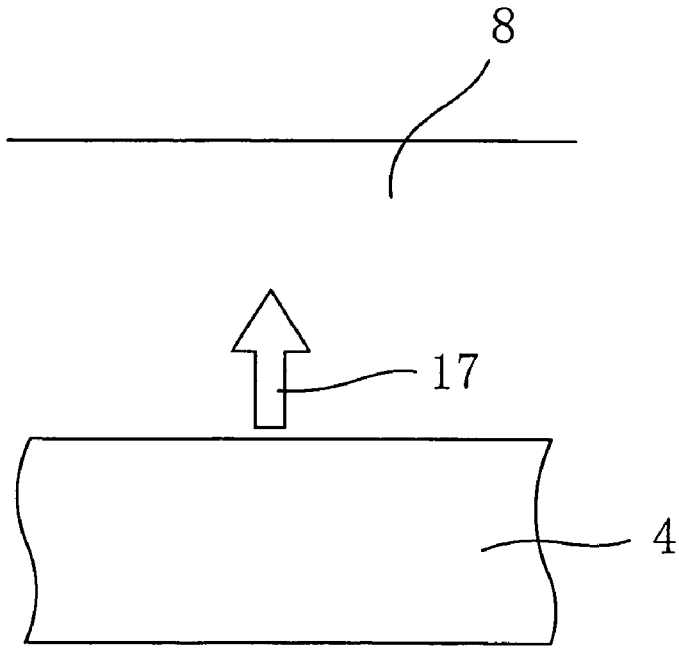

Next, the reason why the strength of the lamp 100 against pressure is increased by the compressive strain in the second glass portion 7 will be described with reference to FIG. 19. FIG. 19A is an enlarged view of the principal part of the sealing portion 2 of the lamp 100, and FIG. 19B is an enlarged view of the principal part of the sealing portion 2 of the comparative lamp 100'.

There are still unclear aspects as to the mechanism that increases the strength of the lamp 100 against pressure, but the inventors have inferred as follows.

First, the premise is that the metal foil 4 in the sealing portion 2 is heated and expanded during lamp operation, so that a stress from the metal foil 4 is applied to the glass portion of the sealing portion 2. More specifically, in addition to the fact that the thermal expansion coefficient of metal is larger than that of glass, the metal foil 4 which is thermally connected to the electrode rod 3 and through which current is transmitted is heated more readily than the glass portion of the sealing portion 2. Therefore, stress is applied more readily from the metal foil 4 (in particular, from the side of the foil whose area is small) to the glass portion.

As shown in FIG. 19A, it seems that when a compressive stress is applied in the longitudinal direction of the second glass portion 7, the occurrence of a stress 16 from the metal foil 4 can be suppressed. In other words, it seems that the compressive stress 15 of the second glass portion 7 can suppress the occurrence of the large stress 16. As a result, for example, the possibility of generating cracks in the glass portion of the sealing portion 2 or causing leakage between the glass portion of the sealing portion 2 and the metal foil 4 is reduced, so that the strength of the sealing portion 2 can be improved.

On the other hand, as shown in FIG. 19B, in the case of the structure not provided with the second glass portion 7, it seems that a stress 17 from the metal foil 4 is larger than in the case of the structure shown in FIG. 19A. In other words, it seems that since there is no region to which a compressive stress is applied in the surroundings of the metal foil 4, the stress 17 from the metal foil 4 becomes larger than the stress 16 shown in FIG. 19A. Therefore, it is inferred that the structure shown in FIG. 19A can increase the strength against pressure more than the structure shown in FIG. 19B. This inference is compatible with a general nature of glass in which when a tensile strain (tensile stress) is present in glass, then the glass is easily broken, and when a compressive strain (compressive stress) is present in glass, then the glass is hardly broken.

However, from the general nature of glass in which the presence of a compressive stress in glass makes the glass less breakable, it cannot be inferred that the sealing portion 2 of the lamp 100 has a high strength against pressure. This is because of the following possible inference. Even if the strength of the glass in a region having a compressive strain is increased, a load is assumed to be generated in the sealing portion 2, taken altogether, as compared to the case where there is no strain. The load would in turn reduce the strength of the sealing portion 2 as a whole. However, it was not found until the inventors sampled and studied the lamp 100 that the strength of the lamp 100 against pressure was improved, which could not be derived from only a theory. If a compressive stress larger than necessary remains in the second glass portion 7 (or the vicinity of the outer circumference thereof), the sealing portion 2 may actually be damaged during lamp operation and the life of the lamp may be shortened on the contrary. In view of these, the structure of the lamp 100 having the second glass portion 7 probably exhibits a high strength against pressure under a superb balance between various conditions. Inferring from the fact that the stress and strain of the second glass portion 7 are released when a portion of the luminous bulb 1 is cut, a load due to the stress and strain of the second glass portion 7 may be well received by the entire luminous bulb 1.

It is also inferred that the structure exhibiting a higher strength against pressure is brought about by a portion 20 of the sealing portion 2 to which is applied a compressive stress generated by the difference in the compressive strain between the first glass portion 8 and the second glass portion 7. More specifically, the following inference is possible. There is substantially no compressive strain in the first glass portion 8 and a compressive strain is well confined into a region of only the second glass portion 7 (or the vicinity of the outer circumference) positioned closer to the center than the portion 20 to which a compressive stress is applied. This would succeed in providing excellent withstand pressure characteristics. As a result of the fact that stress values are shown discretely because of the principle of the strain measurement by the sensitive color plate method, the portion 20 to which a compressive stress is applied is distinctly shown in FIG. 19 or other drawings. However, even if actual stress values can be shown continuously, the stress values are believed to change drastically in the portion 20 to which a compressive stress is applied, and it seems that the portion 20 to which a compressive stress is applied can be defined by the region where the stress value changes drastically.

Figure 3A:
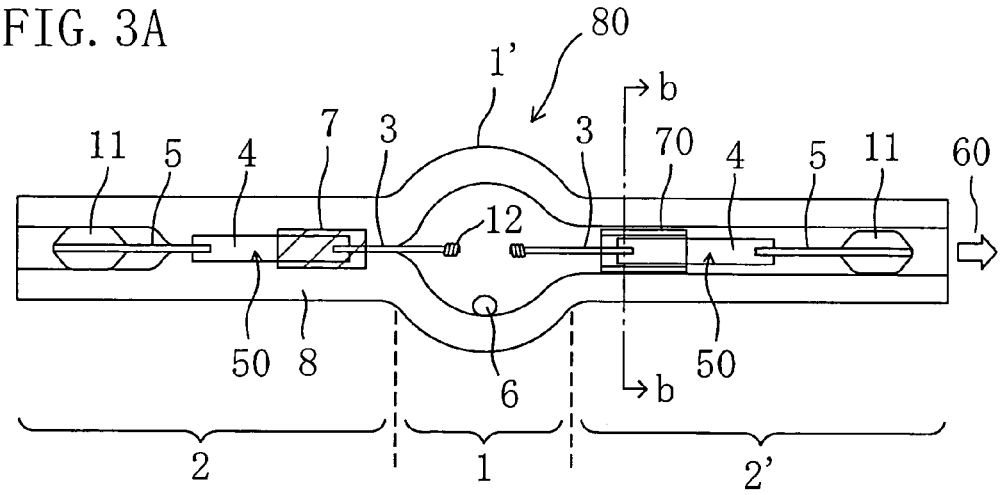
FIGS. 3A and 3B are cross-sectional views for explaining a certain process step of a method for producing the lamp 100.

In forming the lamp 100, first, a first sealing portion is formed from one side tube portion of a glass pipe for a discharge lamp. Subsequently, as shown in FIG. 3A, a glass tube 70 and an electrode structure 50 are inserted into a side tube portion 2' of the glass pipe 80. The electrode structure 50 includes the electrode rod 3, the metal foil 4 connected to the electrode rod 3 and an external lead 5 connected to the metal foil 4. A supporting member (metal hook) 11 for fixing the electrode structure 50 onto the inner surface of the side tube portion 2' is provided at one end of the external lead 5. Subsequently to this and prior to formation of a second sealing portion (prior to a second sealing process), a vacuum pump (not shown) exhausts gas within the glass pipe 80 as shown by the arrow 60. In this embodiment, vacuum evacuation is conducted after a luminous substance (mercury or the like) 6 is introduced. It is alternatively possible to introduce the luminous substance (mercury or the like) 6 after the vacuum evacuation.

Figure 3B:
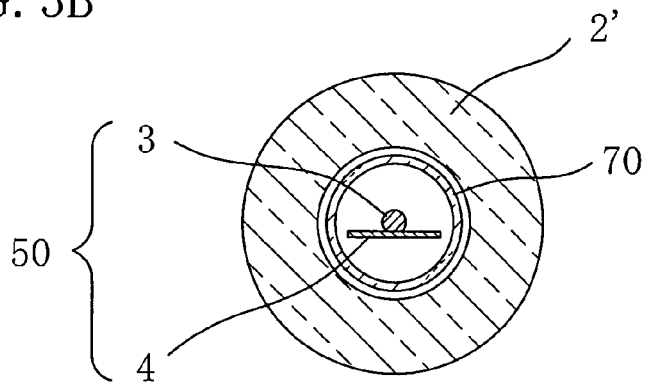

In the structure shown in FIG. 3, the glass tube 70 is disposed inside the side tube portion 2', so that an exhaust path (that is to say, the inside of the side tube portion) becomes thinner than the structure in which the glass tube 70 is absent, resulting in an increased exhaust resistance (in other words, the exhaust conductance decreases). This disadvantageously causes an insufficient evacuation in the vacuum evacuation process.

If the glass tube 70 is made of Vycor glass, the glass tube 70 adsorbs many impurities (mainly water) because Vycor glass has a porous structure. In this case, evacuation only by the vacuum pump can hardly remove the adsorbed impurities, or, even though it can remove them, it takes a much longer time to do so than in the case where the glass tube 70 of Vycor glass is not used. Therefore, the presence of the glass tube 70 of Vycor glass is disadvantageous for an industrial production. If the adsorbed substances are present on the glass tube 70, the substances in the form of bubble still remain in the glass of the sealing portion even after the formation of the sealing portion. This causes reduction in the glass strength (that is to say, a decrease in withstand pressure).

The inventors closely studied solutions of these problems and then found that use of a getter in addition to the vacuum pump can solve these problems. Thus, the present invention has been made.

Hereinafter, embodiments of the present invention will be described with reference to the accompanying drawings. In the following drawings, for simplification of description, the elements having substantially the same function bear the same reference numeral. The present invention is not limited to the following embodiments.

(First Embodiment)

Figure 4:
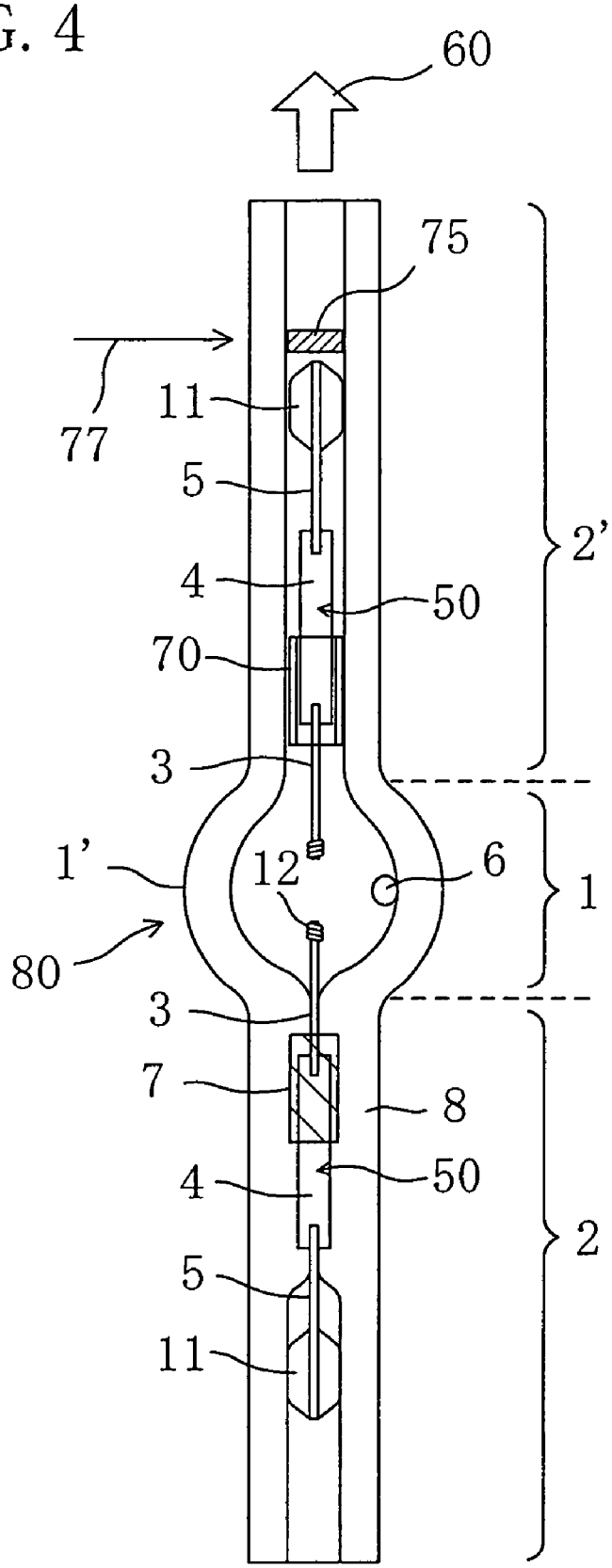
FIG. 4 is a schematic view showing the structure of a glass pipe 80 having a getter 75 (a lamp member for a high pressure discharge lamp).

A method for producing a high pressure discharge lamp according to each embodiment of the present invention is characterized in that a getter is disposed in a side tube portion of a glass pipe and the pressure inside the glass pipe is reduced using the getter. FIG. 4 shows the structure in which the glass pipe 80 shown in FIG. 3A is placed vertically. In this structure, a getter 75 is disposed in the upper portion of the side tube portion 2'. Note that the structure shown in FIG. 4 can be called a lamp member for a high pressure discharge lamp.

In the production method of this embodiment, the glass pipe 80 for a discharge lamp is prepared and then the glass member (for example, a glass tube) 70 made of a second glass whose softening point is lower than that of a first glass constituting the side tube portion 2' is inserted into the side tube portion 2'. Subsequently, the getter 75 is disposed in the side tube portion 2'. While the pressure inside the glass pipe 80 is reduced, the side tube portion 2' is heated to tightly attach the glass member (for example, a glass tube) 70 to the side tube portion 2'. Thus, a sealing portion is formed.

The getter 75 is disposed, for example, in an upper (more backward) position of the side tube portion 2' than the metal foil 4. It is preferably disposed in an upper (more backward) position thereof than the supporting member 11 (molybdenum tape). If it is disposed in an upper (more backward) position thereof than the supporting member 11, it can be removed upon eliminating unnecessary portions after the sealing process. The getter is a substance capable of adsorbing gas onto its surface. In this embodiment, ZrVFe is used as the getter 75. The getter 75 in this embodiment is a getter for a PDP (plasma display panel) and is of, for example, a cylindrical shape. The getter 75 preferably has a diameter smaller than the inside diameter of the side tube portion 2'. When the getter 75 is heated, it is activated. The use of this characteristic in the structure shown in FIG. 4 to heat the getter 75 with a heating means 77 (for example, a burner or a laser) from the outside of the side tube portion 2' allows the getter 75 to absorb residual gas within the glass pipe 80. As a result, the degree of vacuum in the glass pipe 80 can be increased. The getter 75 may be disposed to come into contact with the supporting member 11 in the glass pipe 80 vertically placed. Also, when the getter 75 is heated for activation, a portion of the side tube portion 2' at which the getter 75 is disposed may be shrunk by heating to temporarily seal (temporarily fix) the getter 75 in the side tube portion 2'.

Figure 5:
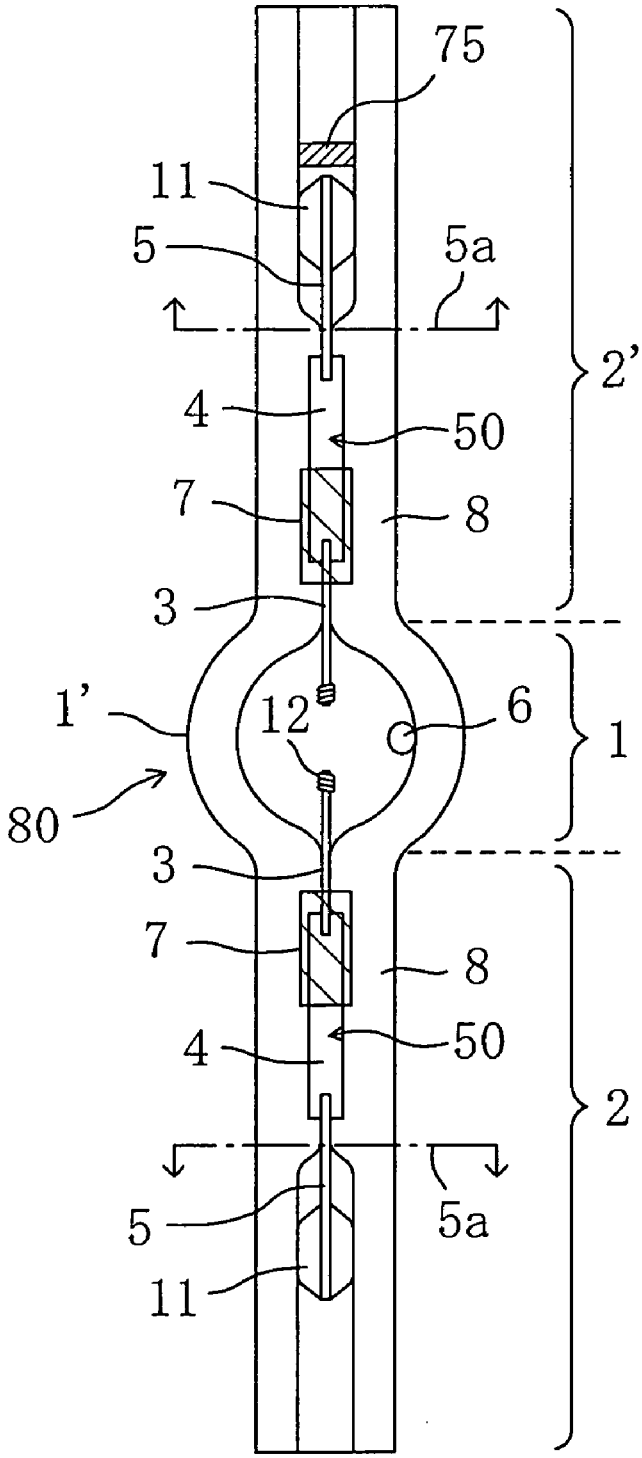
FIG. 5 is a schematic view showing the structure of the glass pipe 80 which has the getter 75 and is formed with both sealing portions 2.

After the pressure-reduction step (vacuum evacuation step), with the pressure inside the glass pipe 80 reduced, the side tube portion 2' is shrunk by heating. Thus, as shown in FIG. 5, the other sealing portion (a second sealing portion)

is formed. The resulting glass pipe 80 is cut along, for example, the lines 5*a* in FIG. 5 to remove unnecessary portions of the side tube portions. Then, in order to obtain the external leads 5 of predetermined length, unnecessary portions of the external leads 5 are removed. Thus, a half-finished structure of a high pressure discharge lamp is obtained. The half-finished structure (or a half-finished lamp assembly) herein called is a high pressure discharge lamp provided with the both sealing portions 2 and the luminous bulb 1.

In order to apply a compressive stress of about 10 kgf/cm$^2$ or more to the second glass portion 7 of the half-finished lamp assembly, the half-finished lamp assembly is heated, for example, at 1030° C. for two hours or more. The heating condition or the like will be described later. A temperature of 1030° C. herein used is higher than the strain point temperature of the second glass (for example, Vycor glass) and lower than the strain point temperature of the first glass (for example, quartz glass).

In the production process described above, subsequently to the formation of one sealing portion (a first sealing portion) 2 and prior to the formation of the other sealing portion (a second sealing portion) 2, halogen precursor to be decomposed into halogen is introduced. As the halogen precursor introduced at this time, preferable use is made of mercuric bromide ($HgBr_2$), which is a solid and stable halogen precursor, rather than gaseous halogen precursor (for example, $CH_2Br_2$ or HBr). The reason for this is as follows. Since $CH_2Br_2$, for example, is a relatively heavy gas, it is difficult to diffuse $CH_2Br_2$ and absorb $CH_2Br_2$ into the getter 75. On the other hand, it is much more difficult to absorb solid $HgBr_2$ into the getter 75 than gaseous $CH_2Br_2$, so that $HgBr_2$ is more compatible with the production process using the getter 75 than $CH_2Br_2$. Moreover, since there is a possibility that solid $HgBr_2$ has impurities adsorbed thereon, the combination of the getter 75 and $HgBr_2$ is preferable even for the purpose of removing the impurities. An alternative manner may be applied in which the amount of gaseous halogen precursor (for example, $CH_2Br_2$ or HBr) to be absorbed is estimated in advance and the precursor is introduced excessively by the estimated amount.

The technical significance of the introduction of halogen precursor will now be described. It is to utilize halogen cycles in lamp operation and to increase the life of a high pressure discharge lamp by the halogen cycle. In order to realize a long-life lamp, the introduction step of halogen precursor to be decomposed into halogen is important. The halogen amount necessary for a satisfactorily sustainable halogen cycle is detailed in the International Patent Application No. PCT/JP00/04561 (the international filing date: Jul. 6, 2000, applicant: Matsushita Electric Industrial Co., Ltd.), the contents of which are incorporated herein by reference. Note that bromine ($Br_2$) can be used as a halogen species. However, since bromine has very high reactivity, in consideration of handling, the halogen introduction is preferably performed with halogen precursor to be decomposed into halogen (for example, $HgBr_2$, $CH_2Br_2$ or HBr). However, if the long life properties of the lamp are not demanded, the introduction step of halogen precursor or halogen can be omitted.

In the production method of this embodiment, the getter 75 keeps on absorbing impurity gas (residual gas) in the glass pipe 80 until the sealing process is completed, so that the getter 75 can be used as an auxiliary means for evacuation. Consequently, even though the glass tube 70 is inserted into the side tube portion 2', the glass pipe 80 can be evacuated sufficiently. Moreover, the getter 75 can remove impurities (for example, water) adsorbed onto the glass tube 70 (for example, a glass tube made of Vycor glass), so that the occurrence of bubbles in glass of the sealing portion 2 and then the degradation in the glass strength (that is to say, the degradation in the withstand pressure) by the bubbles can be prevented.

Figure 6:
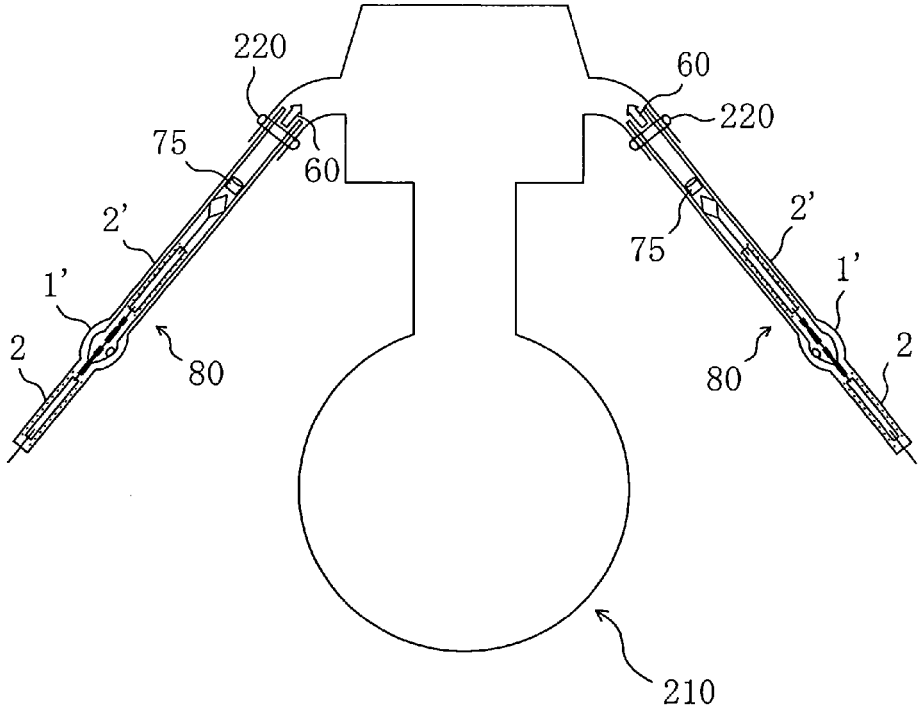
FIG. 6 is a schematic view showing the configuration in which the glass pipes 80 (a lamp member for a high pressure discharge lamp) are coupled to a vacuum pump (a turbo molecular pump).

The inventors have found from various studies that the degree of vacuum in the glass pipe 80 with no getter 75 is 0.002 kPa while the degree of vacuum in the glass pipe 80 with the getter 75 is 0.0001 kPa, so that the getter 75 can truly improve the degree of vacuum by more than 20 times. The inventors have also found that the high pressure discharge lamp with the getter 75 produced by the production method of this embodiment is resistant to blackening. When the lamp yields against early blackening was checked by two-hour operation tests conducted after the completion of the lamps, the percentage of blackened lamps dropped to half The measured contents of $H_2$ and $H_2O$ gases remaining in the luminous bulb 1 of the high pressure discharge lamp produced by the production method of this embodiment were as follows. The contents of $H_2$ and $H_2O$ gases remaining in the lamp produced by the production method using no getter 75 were 0.2 kPa and 0.015 kPa, respectively. On the other hand, the contents of $H_2$ and $H_2O$ gases remaining in the lamp produced by the production method of this embodiment using the getter 75 were 0.009 kPa or less and 0.001 kPa or less (or less than 0.001 kPa), respectively. As is apparent from the above, the production method of this embodiment can significantly reduce the contents of $H_2$ and $H_2O$ gases remaining in the luminous bulb 1 of the high pressure discharge lamp, for example, to 0.009 kPa or less and 0.001 kPa or less, respectively. Since $H_2$ and $H_2O$ gases degrade the life of a lamp, it is better that the contents thereof are smaller. Thus, the reduction in the remaining gases probably results from the effect of adsorption of the remaining gases by the getter 75 during the production process.

Where the glass pipe 80 is evacuated by a vacuum pump in combination with the getter 75 in the production method of this embodiment, the evacuation need only be performed in the configuration, for example, as shown in FIG. 6. In this configuration, an open end of the side tube portion 2' of the glass pipe 80 is coupled to a vacuum pump 210 using a clamping part (for example, an O-ring) 220. Multiple glass pipes 80 can be coupled to the vacuum pump 210. The vacuum pump 210 used in this configuration is a turbo pump (specifically, a turbo molecular pump) capable of creating a degree of vacuum of about $10^{-8}$ Torr. In this configuration, the evacuation is performed, for example, for five minutes or more, preferably for ten minutes or more. From the viewpoint of the schedule of the production process, the evacuation may be performed for a night (about ten hours or more), or for a night and day (about twenty hours or more).

Figure 7:
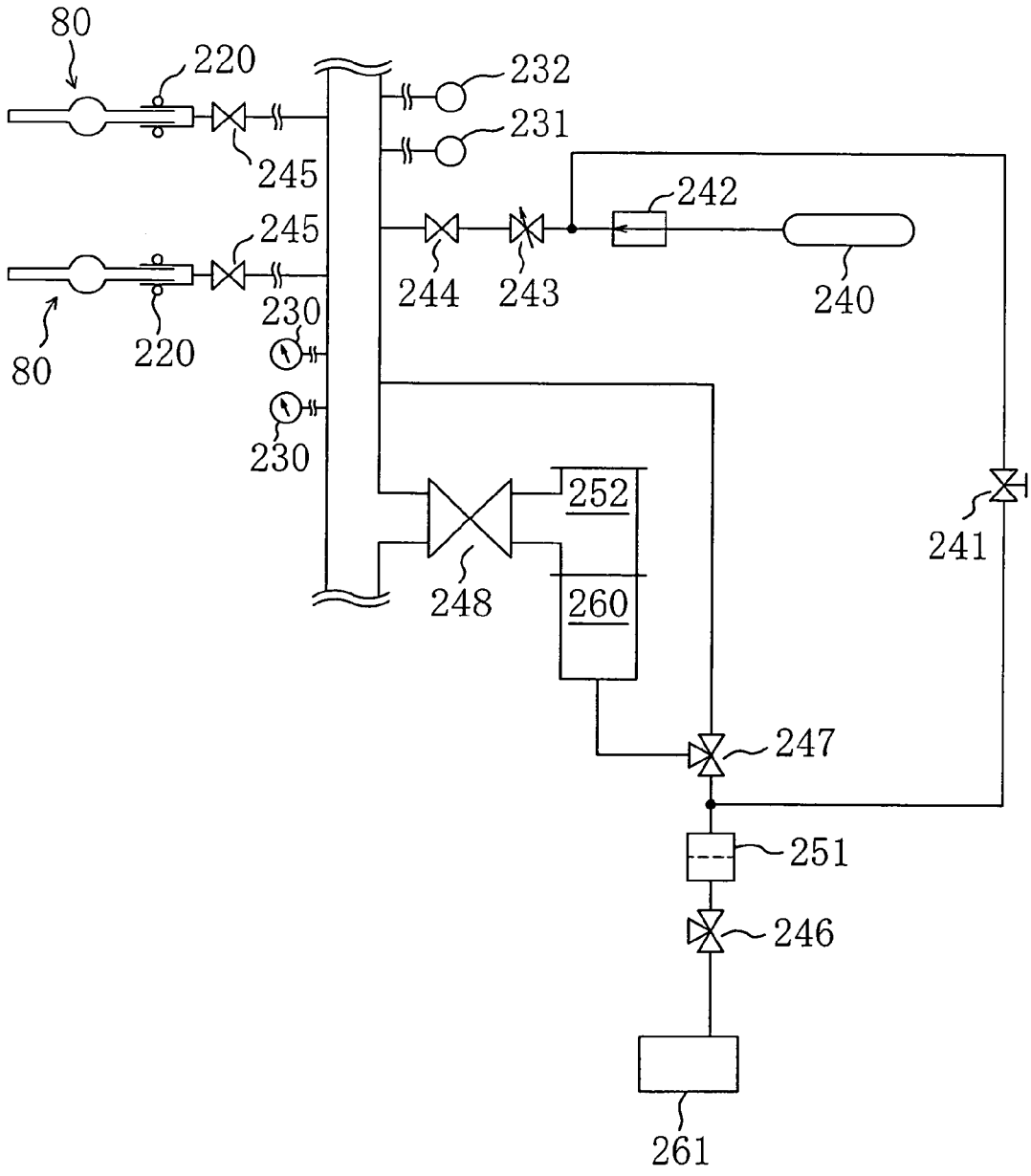
FIG. 7 is a schematic diagram showing the configuration of a vacuum system according to an embodiment of the present invention.

FIG. 7 shows the details of the configuration shown in FIG. 6. In a vacuum line or a vacuum system shown in FIG. 7, the reference numerals 80 and 220 denote a glass pipe and an O-ring, respectively. The reference numerals 230, 231 and 232 denote a capsule gauge, a Pirani gauge and an ionization gauge, respectively. The reference numeral 240 denotes an Ar (argon) cylinder. The reference numerals 241, 242, 243, 244 and 245 denote an exhaust valve, a regulator, a needle valve, a gas inlet valve, and a cut valve, respectively. The reference numerals 246, 247 and 248 denote a pump leak valve, a three-way valve, and a main valve, respectively. The reference numerals 251 and 252 denote a foreline trap and a liquid nitrogen trap ($LN_2$ trap), respectively. The reference numerals 260 and 261 denote a turbo molecular pump and a rotary pump, respectively.

In this embodiment, the turbo molecular pump is used as a vacuum pump. Even though not the turbo molecular pump but an oil diffusion pump (in other words, a rotary pump of which the degree of vacuum is about $10^{-3}$ Torr) generally used in the evacuation of a glass pipe is used in combination with the getter 75, a greater effect can be exerted than in the case of using the oil diffusion pump alone. This combination facilitates the evacuation step and reduces impurity gas ($H_2$ or $H_2O$) within the luminous bulb 1. It is needless to say that use of only the oil diffusion pump as a vacuum pump decreases facility costs.

Next, description will be made of the structure of a high pressure discharge lamp (in particular, a high pressure mercury lamp) provided by the production method of this embodiment. The structure of the high pressure discharge lamp according to this embodiment is basically identical to the lamp structure shown in FIG. 1. Hence, with reference to FIG. 1, the high pressure discharge lamp of this embodiment will be described. For ease of explanation, the high pressure discharge lamp produced by the production method of this embodiment is also denoted by the reference numeral 100 and items overlapping with those of the structure shown in FIG. 1 will be omitted or simplified.

The lamp 100 in this embodiment is a double ended type lamp provided with two sealing portions 2. As shown in FIG. 1, the luminous bulb 1 is designed in a tipless shape. Because of this design, it is necessary to introduce a luminous substance and halogen precursor not from an opening provided in the luminous bulb 1 but from a side tube portion. It is preferable that the second glass portion 7 is disposed to cover at least a welded portion of the electrode rod 3 to the metal foil 4, which reduces the probability of breakage of the lamp even under the condition of an ultrahigh withstand pressure such as 35 MPa. As an example of the structure in which the second glass portion 7 covers the welded portion of the electrode rod 3 and the metal foil 4, the second glass portion 7 is disposed to cover the whole of the portion of the metal foil 4 buried in the sealing portion 2 and a portion of the electrode rod 3.

In this embodiment, the luminous bulb 1 encloses mercuric bromide ($HgBr_2$) as halogen precursor to be decomposed into halogen. The halogen created by decomposing $HgBr_2$ (that is, bromine (Br)) serves for the halogen cycles that returns W (tungsten) evaporated from the electrodes rod 3 during lamp operation to the electrode rod 3 again. The amount of enclosed $HgBr_2$ is about 0.002 to 0.2 mg/cc. This corresponds to about 0.01 to 1 μmol/cc in terms of the halogen atom density during lamp operation.

An additional advantage of the use of $HgBr_2$ as halogen precursor is to create Br and Hg by decomposing $HgBr_2$. In other words, the resulting component other than halogen is mercury which is identical to an element having enclosed therein. In this point, $HgBr_2$ differs from the $CH_2Br_2$ or HBr which will create hydrogen (H). Hydrogen possibly combines with halogen again, so that the amount of free halogen may not be fixed because it depends upon the amount of free hydrogen. As disclosed in the International Patent Application No. PCT/JP00/04561, halogen contributing to the halogen cycle is always held in the luminous bulb 1 to surely conduct the halogen cycle, whereby the blackening occurring in the luminous bulb 1 can be positively prevented. If it is assumed that an enclosed component decomposes into hydrogen (free hydrogen), however, halogen having combined with the free hydrogen does not always contribute to the halogen cycle. Consequently, the amount of free halogen capable of surely contributing to the halogen cycle is not fixed, so that there is a possibility that the blackening cannot be prevented positively.

As a result of the above discussion, $HgBr_2$ is found to be more advantageous because it can eliminate the above possibility and the amount of halogen to be introduced is easily estimated. However, since $HgBr_2$ is solid, impurities might adhere to $HgBr_2$ used. In that case, as mentioned above, the effect of the getter 75 is further exerted.

In this embodiment, it is preferable that the number of moles of halogen created by $HgBr_2$ enclosed in the luminous bulb 1 is greater than the sum of the number of moles of all metal elements having the properties of combining with halogen (other than tungsten element and mercury element) and existing in the luminous bulb 1 and the number of moles of tungsten present in the luminous bulb 1 as the result of evaporation from the electrode 3 during the lamp operation. Thus, halogen contributing to the halogen cycle can always be held in the luminous bulb 1 to surely conduct the halogen cycle. A typical metal element having the properties of combining with halogen is, other than tungsten element and mercury element, alkali metal element (for example, Na (sodium), K (potassium) and Li(lithium)).

The strength against pressure (operating pressure) of the lamp 100 according to this embodiment can be 20 MPa or more (e.g., about 30 to 50 MPa or more). Moreover, the bulb wall load can be, for example, about 60 W/cm$^2$ or more, and the upper limit is not provided. For example, a lamp having a bulb wall load, for example, in the range from about 60 W/cm$^2$ to about 300 W/cm$^2$ (preferably about 80 to 200 W/cm$^2$) can be realized. If cooling means is provided, a bulb wall load of 300 W/cm$^2$ or more can be achieved. The rated power is, for example, 150 W (the bulb wall load in this case corresponds to about 130 W/cm$^2$).

Hereinafter, the lamp structure of this embodiment will be detailed further.

The luminous bulb 1 of the lamp 100 is substantially spherical, and is made of quartz glass as in the case of the first glass portion 8. In order to realize a high pressure mercury lamp (in particular, ultrahigh pressure mercury lamp) exerting excellent properties such as a long life, it is preferable to use high purity quartz glass having a low level of alkali metal impurities (e.g., 1 ppm or less of each of Na, K, Li) as the quartz glass constituting the luminous bulb 1. It is of course possible to use quartz glass having a regular level of alkali metal impurities. The outer diameter of the luminous bulb 1 is, for example, about 5 mm to 20 mm. The thickness of the glass of the luminous bulb 1 is, for example, about 1 mm to 5 mm. The volume of the discharge space (10) in the luminous bulb 1 is, for example, about 0.01 to 1 cc (0.01 to 1 cm$^3$). In this embodiment, use is made of a luminous bulb 1 having an outer diameter of about 9 mm, an inner diameter of about 4 mm, and a volume of the discharge space of about 0.06 cc.

A pair of electrode rods (electrodes) 3 are opposed in the luminous bulb 1. The heads of the electrode rods 3 are disposed in the luminous bulb 1 with a distance (arc length) of about 0.2 to 5 mm (e.g., 0.6 mm to 1.0 mm), and each of the electrode rods 3 is made of tungsten (W). Use is preferably made of the tungsten electrode rods 3 having a low level of alkali metal impurities (e.g., 1 ppm or less of each of Na, K, Li) as well, but it is also possible to use the electrode rods 3 having a regular level of alkali metal impurities. A coil 12 is wound around the head of the electrode rod 3 for the purpose of reducing the temperature of the head of the electrode during lamp operation. In this embodiment, a coil made of tungsten is used as the coil 12, but a coil made of thorium-tungsten can be used. Similarly, for the electrode rod 3, not only a tungsten rod, but also a rod made of thorium-tungsten can be used.

Mercury 6 as a luminous material is enclosed in the luminous bulb 1. To operate the lamp 100 serving as an ultrahigh pressure mercury lamp, about at least 200 mg/cc or more (220 mg/cc or more, 230 mg/cc or more, or 250 mg/cc or more), preferably 300 mg/cc or more (e.g., 300 mg/cc to 500 mg/cc) of mercury 6, a rare gas (e.g., argon) at 5 to 30 kPa, and $HgBr_2$ as halogen precursor, whose amounts are based on the internal volume of the luminous bulb 1, are enclosed in the luminous bulb 1.

As described above, the cross-sectional shape of the sealing portion 2 is substantially circular, and the metal foil 4 is provided substantially in the central portion thereof. The metal foil 4 is, for example, a rectangular molybdenum foil (Mo foil), and the width of the metal foil 4 (the length of the shorter side) is, for example, about 1.0 mm to 2.5 mm (preferably, about 1.0 mm to 1.5 mm). The thickness of the metal foil 4 is, for example, about 15 μm to 30 μm (preferably about 15 μm to 20 μm). The radio of the thickness and the width is about 1:100. The length of the metal foil 4 (the length of the longer side) is, for example, about 5 mm to 50 mm.

The external lead 5 is provided by welding on the side of the sealing portion 2 opposite to the side on which the electrode rod 3 is positioned. The external lead 5 is connected to the side of the metal foil 4 opposite to the side to which the electrode rod 3 is connected, and one end of the external lead 5 extends to the outside of the sealing portion 2. The external lead 5 is electrically connected to a ballast circuit (not shown) to electrically connect the ballast circuit to the pair of electrode rods 3. The sealing portion 2 serves to retain the airtightness in the discharge space 10 in the luminous bulb 1 by attaching the glass portions (7, 8) to the metal foil 4 with pressure. The sealing mechanism by the sealing portion 2 will be described briefly below.

The material constituting the glass portion of the sealing portion 2 and molybdenum constituting the metal foil 4 differ in the thermal expansion coefficient. Therefore, in view of the thermal expansion coefficient, the glass portion and the metal foil 4 are not integrated into one unit. However, in the case of this structure (foil sealing), the metal foil 4 is plastically deformed by the pressure from the glass portion of the sealing portion, so that the gap between them can be filled. Thus, the glass portion of the sealing portion 2 and the metal foil 4 can be attached with pressure, and thus the luminous bulb 1 can be sealed with the sealing portion 2. That is to say, by means of foil sealing by pressing the glass portion of the sealing portion 2 against the metal foil 4 to achieve attachment, the sealing portion 2 is sealed. In this embodiment, since the second glass portion 7 having a compressive strain is provided, the reliability of this sealing structure is improved.

In the lamp 100 according to this embodiment, the second glass portion 7, provided at least in a portion of the inside of the first glass portion 8, is subjected to compressive strain (at least in its longitudinal direction), thereby improving the strength against pressure of the high pressure discharge lamp. Moreover, the getter 75 in the production stage contributes to reduction in residual gas ($H_2$, $H_2O$ or the like) in the luminous bulb 1 and can suppress the blackening of the lamp 100.

In the structure shown in FIG. 1, the second glass portion 7 is provided in each of the pair of sealing portions 2, but the present invention is not limited to this structure. Also when the second glass portion 7 is provided in only one of the sealing portions 2, the strength of the lamp 100 against pressure can be higher than that of the comparative lamp 100' shown in FIG. 2B. However, it is preferable that the second glass portion 7 is provided in both the sealing portions 2 and both the sealing portions 2 have a region to which a compressive stress is applied. This is because a higher withstand pressure can be achieved when both the sealing portions 2 have a region to which a compressive stress is applied than when only one of them has the region. That is, in the case where both of two sealing portions have a portion to which a compressive stress is applied, the probability that leakage occurs in either of the sealing portions (i.e., the probability that a withstand pressure of a certain level cannot be maintained) can be ½ of the probability in the case where only one of two sealing portions has a portion to which a compressive stress is applied.

In this embodiment, a high pressure mercury lamp having a large amount of mercury 6 enclosed (e.g., an ultrahigh pressure mercury lamp having an amount of enclosed mercury of 150 mg/cm$^3$ or more) has been described. However, the present invention can be applied preferably to a high pressure mercury lamp having a not very high mercury vapor pressure of about 1 MPa. This is because the fact that the lamp can be operated stably even if the operating pressure is very high means that the reliability of the lamp is high. That is to say, if the structure of this embodiment is applied to a lamp having a not very high operating pressure (the operating pressure of the lamp is less than about 30 MPa, for example, about 20 MPa to about 1 MPa), the reliability of the lamp that operates at that operating pressure can be improved. The structure of this embodiment can be obtained simply by introducing the member of the second glass portion 7 as a new member, so that a small improvement can provide an effect of improving the withstand pressure. Therefore, this is very suitable for industrial applications. Moreover, in this embodiment, in consideration of the mechanism of the compositional deformation of the second glass portion 7, $HgBr_2$ which is halogen precursor is employed as a means for preventing the compositional deformation thereof. This also ensures the effect of improving the withstand pressure only by a small improvement, so that this is very suitable for industrial applications.

Figure 8:
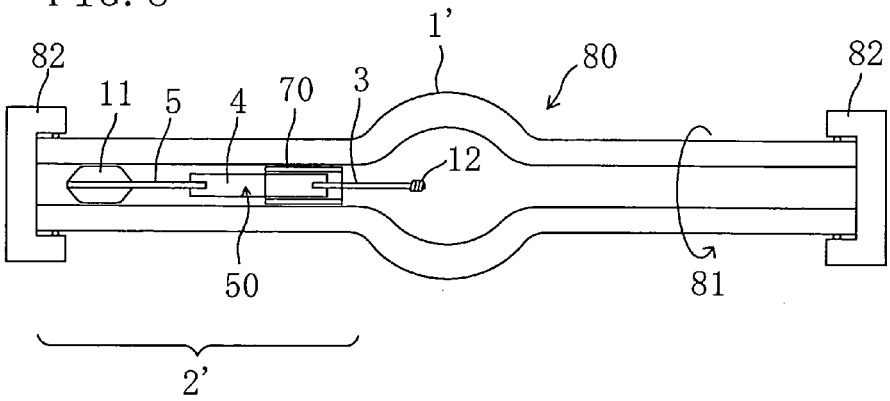
FIG. 8 is a cross-sectional view for explaining a process step of the method for producing the lamp 100.
Figure 9:
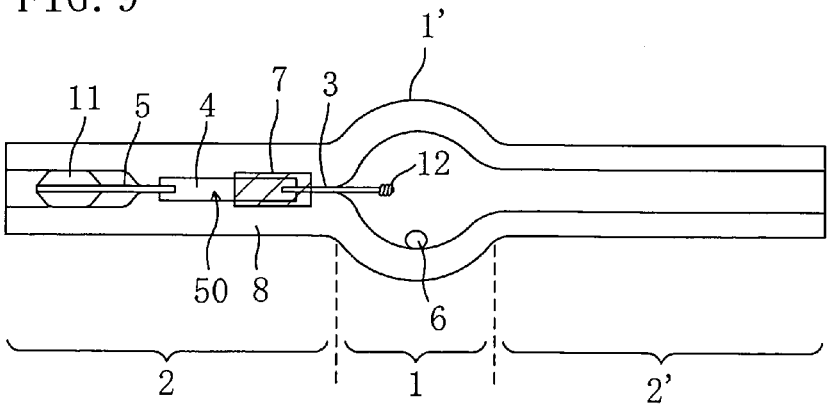
FIG. 9 is a cross-sectional view for explaining a process step of the method for producing the lamp 100.

Next, the method for producing a high pressure discharge lamp according to this embodiment will still be described further using FIGS. 8 and 9.

First, as shown in FIG. 8, the glass pipe 80 for a discharge lamp including the luminous bulb portion 1' that will be formed into the luminous bulb (1) of the lamp 100 and the side tube portions 2' extending from the luminous bulb portion 1' is prepared. The glass pipe 80 of this embodiment is obtained by heating a predetermined position of a cylindrical quartz glass having an outer diameter of 6 mm and an inner diameter of 2 mm for expansion to form the substantially spherical luminous bulb portion 1'. The glass tube 70 that will be formed into the second glass portion 7 is prepared separately. The glass tube 70 of this embodiment is a Vycor glass tube having an outer diameter of 1.9 mm, an inner diameter of 1.7 mm and a length (the longitudinal dimension) of 7 mm. The outer diameter of the glass tube 70 is smaller than the inner diameter of one of the side tube portions 2' of the glass pipe 80 so that the glass tube 70 can be inserted into the side tube portion 2'.

Next, as shown in FIG. 8, the glass tube 70 is fixed to the side tube portion 2' of the glass pipe 80, and then a separately produced electrode structure 50 is inserted into the side tube portion 2' to which the glass tube 70 has been fixed. Subsequently, both ends of the glass pipe 80 with the electrode structure 50 inserted therein are attached to a rotatable chuck 82 while the airtightness in the glass pipe 80 is maintained. The chuck 82 is connected to a vacuum system (not shown) and can reduce the pressure inside the glass pipe 80. After the glass pipe 80 is evacuated to a vacuum, a rare gas (Ar) with about 200 torr (about 20 kPa) is introduced. Thereafter, the glass pipe 80 is rotated around the electrode rod 3 as the central axis for rotation in the direction shown by arrow 81. It is possible to use the getter 75 also in the vacuum evacuation in this stage. This is because the removal of impurity gas by the getter 75 facilitates formation of a good sealing portion in the first sealing process. To be more specific, it is sufficient to dispose the getter 75 behind the supporting member 11 (to the opposite side of the supporting member 11 to the electric rod 12) in the side tube portion 2'.

The electrode structure 50 includes the electrode rod 3, the metal foil 4 connected to the electrode rod 3 and the external lead 5 connected to the metal foil 4. The electrode rod 3 is a tungsten electrode rod, and a tungsten coil 12 is wound around the head thereof. The supporting member (metal hook) 11 for fixing the electrode structure 50 onto the inner surface of the side tube portion 2' is provided in one end of the external lead 5. The supporting member 11 shown in FIG. 8 is a molybdenum tape (Mo tape) made of molybdenum, but this can be replaced by a ring-shaped spring made of molybdenum.

Then, the side tube portion 2' and the glass tube 70 are heated and contracted so that the electrode structure 50 is sealed, and thus, as shown in FIG. 9, the sealing portion 2 provided with the second glass portion 7, which was the glass tube 70, is formed inside the first glass portion 8, which was the side tube portion 2'. The sealing portion 2 can be formed by heating the side tube portion 2' and the glass tube 70 sequentially from the boundary portion between the luminous bulb portion 1' and the side tube portion 2' to the vicinity of the middle portion of the external lead 5 for shrinking. This sealing portion formation process provides the sealing portion 2 including a (portion in which a compressive stress is applied at least in the longitudinal direction of the sealing portion 2 (axis direction of the electrode rod 3) from the side tube portion 2' and the glass tube 70. Heating for shrinking can be performed in the direction from the external lead 5 to the luminous bulb portion 1'.

Thereafter, a predetermined amount of mercury 6 (for example, about 200 mg/cc, about 300 mg/cc, or more than 300 mg/cc) is introduced from the end portion of the side tube portion 2' that is open. In this introduction, halogen precursor (for example, solid $HgBr_2$) is also introduced. Which of the mercury 6 and the halogen precursor is introduced first is insignificant, so that they may be introduced at the same time or either of them may be introduced first.

After the mercury 6 and the halogen precursor (for example, $HgBr_2$) are introduced, as shown in FIG. 4 (or FIG. 6 or FIG. 7), pressure is reduced to remove the residual gas. Subsequently to a sufficient removal of the gas, the other side tube portion 2' is also subjected to the same sealing portion formation process (a second sealing process). Specifically, the residual gas within the glass pipe 80 is removed, after which a rare gas is enclosed and heating is performed for sealing. It is preferable to perform heating for sealing while cooling the luminous bulb portion 1' in order to prevent mercury from evaporating. When both the side tube portions 2' are sealed in this manner, the lamp having the second glass portion 7 in the side tube portion 2 is completed.

Next, the mechanism that applies a compressive stress to the second glass portion 7 (or the vicinity of the circumference thereof) by the sealing portion formation process will be described with reference to FIGS. 20A and 20B. This mechanism has been inferred by the inventors, and therefore the true mechanism may not be like this. However, for example, as shown in FIG. 3A, it is the fact that a compressive stress (compressive strain) is present in the second glass portion 7 (or the vicinity of the circumference thereof), and also it is the fact that the withstand pressure is improved by the sealing portion 2 including a portion to which the compressive stress is applied.

Figure 20A:
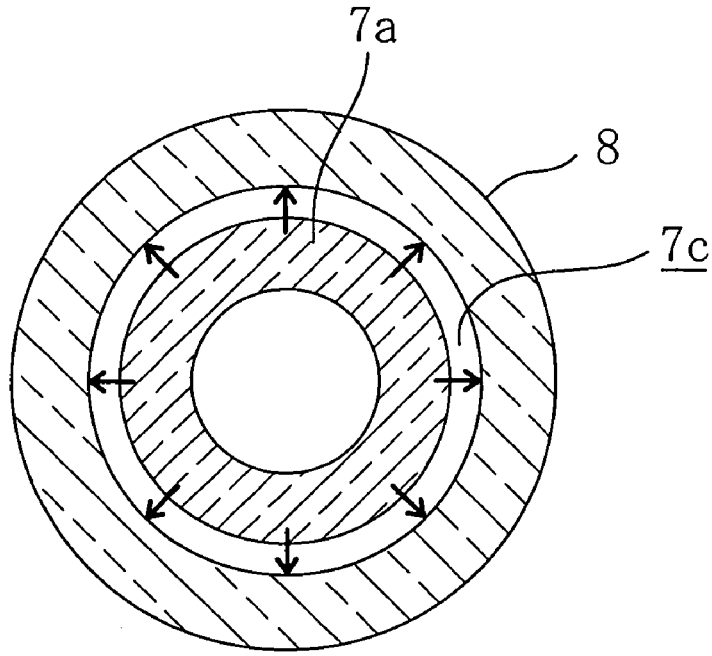
FIGS. 20A and 20B are cross-sectional views for explaining the mechanism that creates compressive strain in the second glass portion.
Figure 20B:
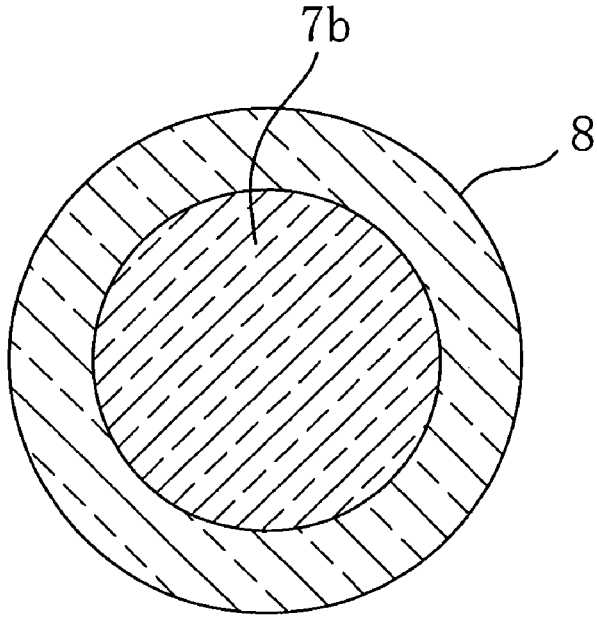

FIG. 20A is a schematic view showing the cross sectional structure at the time when the second glass portion 7*a* that is in the state of the glass tube 70 is inserted into the first glass portion 8 that is in the state of the side tube portion 2'. On the other hand, FIG. 20B is a schematic view showing the cross sectional structure at the time when the second glass portion 7*a* is softened into a molten state 7*b* in the structure of FIG. 20A. In this embodiment, the first glass portion 8 is made of quartz glass containing 99 wt % or more of $SiO_2$, and the second glass portion 7*a* is made of Vycor glass.

First, it is assumed that when a compressive stress (compressive strain) is present, there is a difference in the thermal expansion coefficient between materials that are in contact with each other in many cases. In other words, the reason why a compressive stress is applied to the second glass portion 7 that is provided in the sealing portion 2 is that in general there is a difference in the thermal expansion coefficient between the two components. However, in this case, in reality, there is no large difference in the thermal expansion coefficient between the two components, and they are substantially equal. More specifically, the thermal expansion coefficients of tungsten and molybdenum, which are metals, are about $46\times10^{-7}$/° C. and about 37 to $53\times10^{-7}$/° C., respectively. The thermal expansion coefficient of quartz glass constituting the first glass portion 8 is about $5.5\times10^{-7}$/° C., and the thermal expansion coefficient of Vycor glass is about $7\times10^{-7}$/° C., which is considered to be the same level as that of quartz glass. It does not seem possible that such a small difference in the thermal expansion coefficient causes a compressive stress of about 10 kgf/cm$^2$ or more between them. The characteristic difference between the two components lies in the softening point or the strain point rather than the thermal expansion coefficient. When this aspect is focused on, the following mechanism may explain why a compressive stress is applied. The softening point and the strain point of quartz glass are 1650° C. and 1070° C., respectively (annealing point is 1150° C.). The softening point and the strain point of Vycor glass are 1530° C. and 890° C., respectively (annealing point is 1020° C.).

When the first glass portion 8 (side tube portion 2') that is in the state shown in FIG. 20A is shrunk by heating from the outside, a gap 7*c* initially left between the two components is filled in so that the two components are in tight contact with each other. After shrinking, as shown in FIG. 20B, there is a point of time when the second glass portion 7*b* that is positioned in an inner portion than the first glass portion 8 and has a lower softening point is still softened (still in the molten state) even though at that time the first glass portion 8 having a higher softening point and a larger area in contact with the air is relieved from the softened state (that is the point of time when it is solidified). The second glass portion 7*b* in this point of time has more flowability than the first glass portion 8, so that even if the thermal expansion coefficients of the two components are substantially the same in the regular state (at the time when they are not softened), it can be considered that the properties (e.g., elastic modulus, viscosity, density or the like) of the two components at this point of time are significantly different. Then, time passes further, and the second glass portion 7*b* that had flowability is cooled. Thus, when the temperature of the second glass portion 7*b* becomes lower than the softening point, the second glass portion 7 is also solidified like the first glass portion 8. If the first glass portion 8 and the second glass portion 7 have the same softening point, the two glass portions may be cooled gradually from the outside and solidified without letting a compressive strain remain. However, in the structure of this embodiment, the outer glass portion (8) is solidified earlier and then in some time later, the inner glass portion (7) is solidified. As a result, a compressive strain remains in the second glass portion 7 that is in the inner position. Considering these points, it can be said that the state of the second glass portion 7 is obtained as a result of performing a kind of indirect pinching.

If such a compressive strain remains, in general, the difference in the thermal expansion coefficient between the two components (7 and 8) will terminate the attachment state of the two components at a certain temperature. However, in this embodiment, since the thermal expansion coefficients of the two components are substantially equal, it can be inferred that the attachment state of the two components (7 and 8) can be maintained even if a compressive strain is present.

Furthermore, it was found that in order to apply a compressive stress of about 10 kgf/cm$^2$ or more to the second glass portion 7, it is necessary to heat the lamp constructed by the above-described production method (a half-finished lamp assembly) at a higher temperature than the strain point of the second glass portion 7. In addition, it was also found that it is preferable to heat the lamp at 1030° C. for two hours or more. More specifically, the half-finished lamp assembly 100 can be placed in a furnace with 1030° C. and annealed (i.e., baked under vacuum or reduced pressure). The temperature of 1030° C. is only an example and any temperature that is higher than the strain point temperature of the second glass portion (Vycor glass) 7 can be used. That is to say, the heating temperature can be higher than the strain point temperature of Vycor of 890° C. A preferable range of temperatures is that larger than the strain point temperature of Vycor of 890° C. and lower than the strain point temperature of the first glass portion (quartz glass) (strain point temperature of $SiO_2$ is 1070° C.), but some effect were seen at about 1080° C. or 1200° C. in the experiments conducted by the inventors in some cases.

For comparison, when a high pressure discharge lamp that had not been annealed was measured by the sensitive color plate method, a compressive stress of about 10 kgf/cm$^2$ or more was not observed, although the second glass portion 7 was provided in the sealing portion of the high pressure discharge lamp.

As long as it is at least two hours, there is no limitation regarding the upper limit of annealing (or vacuum baking) except for the upper limit that might be useful in view of economy. Any preferable time can be set as appropriate in the range of two hours or more. If some effect can be seen with a heat treatment for less than two hours, a heat treatment (annealing) can be performed for less than two hours. This annealing process may achieve high purity of the lamp, in other words, reduction in the impurities. This is because it seems that annealing the lamp assembly can remove the water content that is considered to adversely affect the lamp (e.g., the water content of Vycor). If annealing is performed for 100 hours or more, the water content of the Vycor can be removed substantially completely from the lamp.

In the above description, an example in which the second glass portion 7 is formed of Vycor glass has been described. However, even if the second glass portion 7 is formed of glass containing 62 wt % of $SiO_2$, 13.8 wt % of $Al_2O_3$, 23.7 wt % of CuO (product name: SCY2 manufactured by SEMCOM Corporation: Strain point of 520° C.), the state in which a compressive stress is applied at least in the longitudinal direction thereof is found to be achieved.

Next, the mechanism, which is inferred by the inventors, by which a compressive stress is applied to the second glass portion 7 of the lamp when annealing is performed on a lamp assembly at a predetermined temperature for a predetermined period of time or longer will be described with reference to FIG. 21.

Figure 21A:
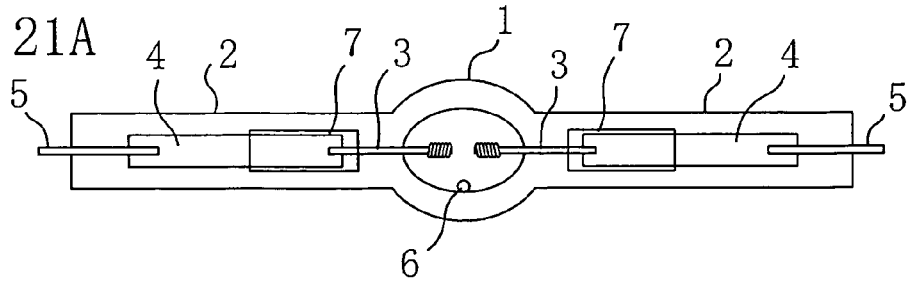
FIGS. 21A to 21D are schematic cross-sectional views for illustrating the mechanism by which compressive stress is applied by annealing.

First, as shown in FIG. 21A, a lamp assembly is prepared. The lamp assembly is produced in the manner as described above.

Figure 21B:
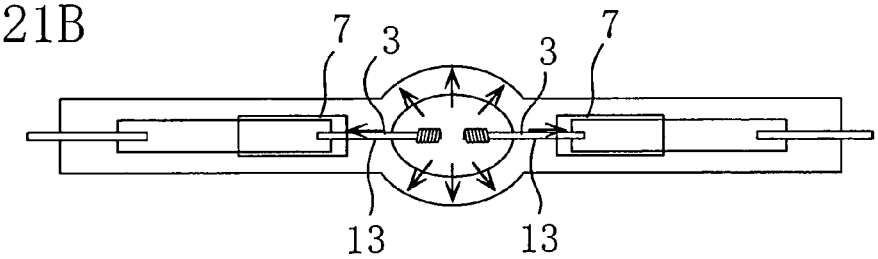

Next, when the lamp assembly is heated, as shown in FIG. 21B, mercury (Hg) 6 starts to evaporate, and as a result, a pressure is applied to the luminous bulb 1 and the second glass portion 7. The arrow in FIG. 21B indicates pressure (e.g., 100 atm or more) caused by the vapor of the mercury 6. The vapor pressure of the mercury 6 is applied not only to the inside of the luminous bulb 1 but also to the second glass portion 7 because there are gaps 13 that cannot recognized by human eyes in the sealed portion of the electrode rods 3.

The temperature for heating is further increased and heating continues at a temperature of more than the strain point of the second glass portion 7 (e.g., 1030° C.). Then, the vapor pressure of mercury is applied to the second glass portion 7 in the state where the second glass portion 7 is soft, so that a compressive stress is generated in the second glass portion 7. It is estimated that a compressive stress is generated in about four hours, for example, when heating is performed at the strain point, and in about 15 minutes when heating is performed at an annealing point. These times are derived from the definitions of the strain point and the annealing point. More specifically, the strain point refers to a temperature at which internal strain is substantially removed after four hour storage at that temperature. The annealing point refers to a temperature at which internal stress is substantially removed after 15 minute storage at that temperature. The above estimated periods of time are derived from these facts.

Figure 21C:
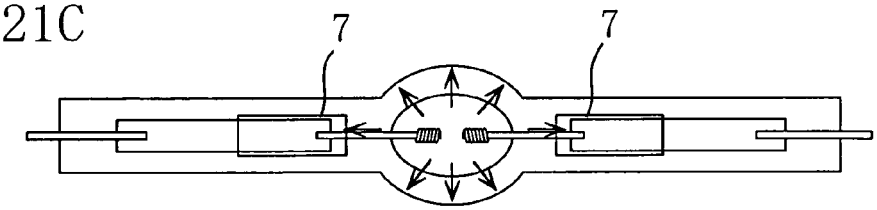
Figure 24A:
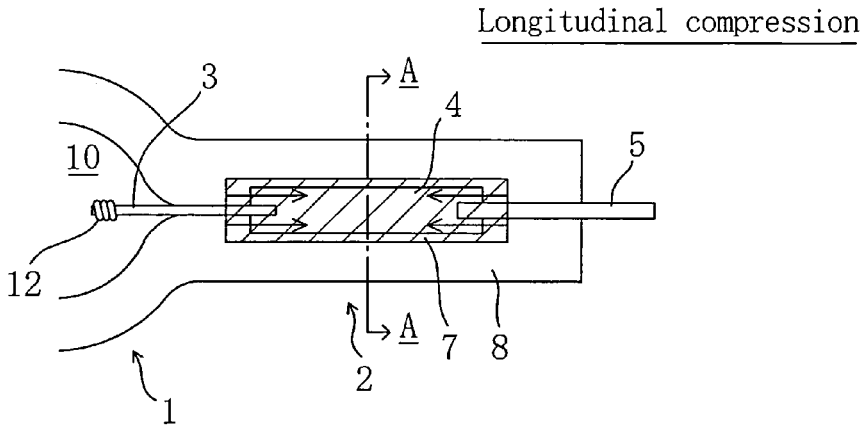
FIG. 24A is a schematic view showing a compressive stress in the longitudinal direction present in the second glass portion.
Figure 24B:
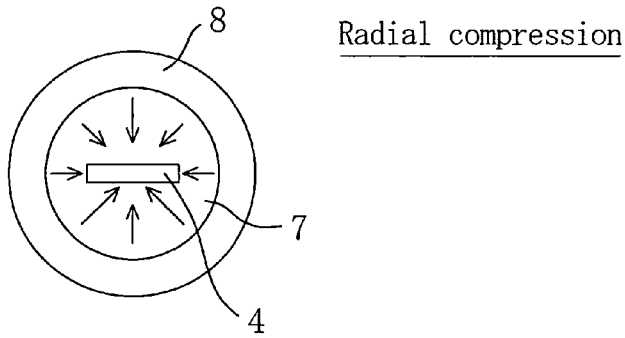
FIG. 24B is a cross-sectional view taken along the line A—A of FIG. 24A.

Next, heating is stopped, and the lamp assembly is cooled. Even after heating is stopped, as shown in FIG. 21C, the mercury continues to evaporate. Therefore, the temperature of the second glass portion 7 is decreased to a temperature lower than the strain point with the portion 7 under the pressure by the mercury vapor. Consequently, as shown in FIG. 24, not only a compressive stress in the longitudinal direction but also a compressive stress in the radial or other direction of the metal foil 4 remain in the second glass portion 7 (however, only the longitudinal compressive stress can be observed with the strain detector.)

Figure 21D:
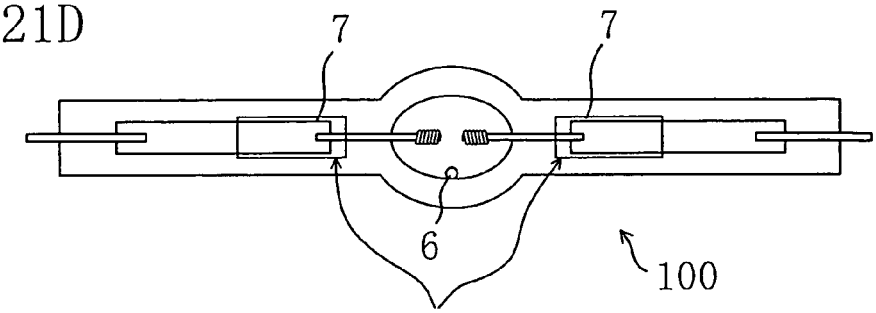

Finally, when cooling proceeds up to about room temperature, as shown in FIG. 21D, a lamp 100 in which a compressive stress of about 10 kgf/cm$^2$ or more is present in the second glass portion 7 can be obtained. As shown in FIGS. 21B and 21C, the vapor pressure of the mercury applies pressure to both the second glass portions 7, so that this approach can apply a compressive stress of about 10 kgf/cm$^2$ or more to both the sealing portions 2 reliably.

Figure 22:
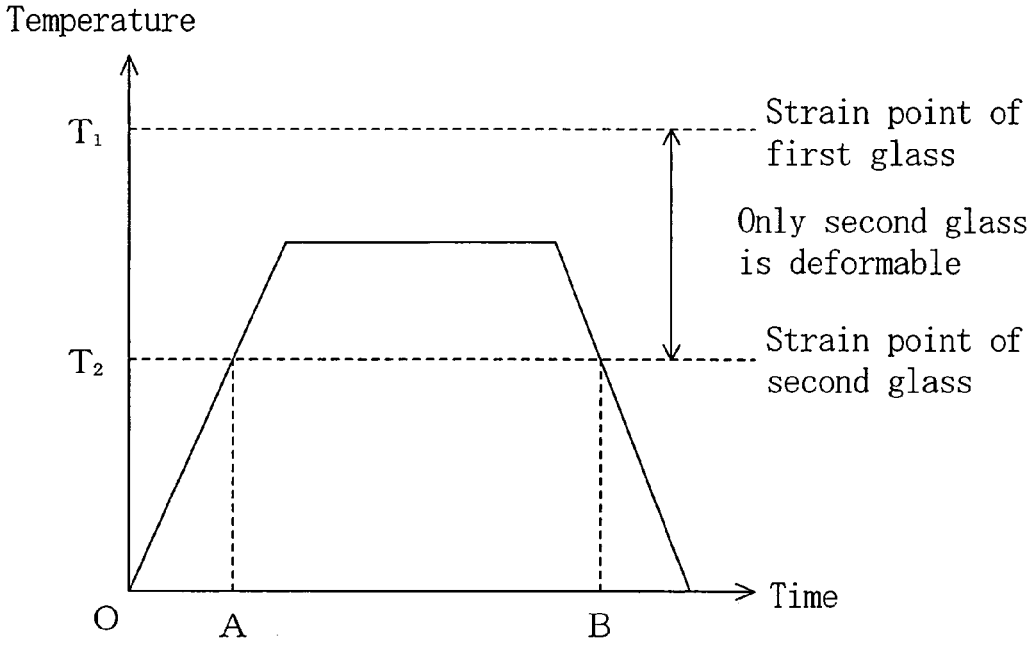
FIG. 22 is a graph schematically showing a profile of a heating process (annealing process).
Figure 23:
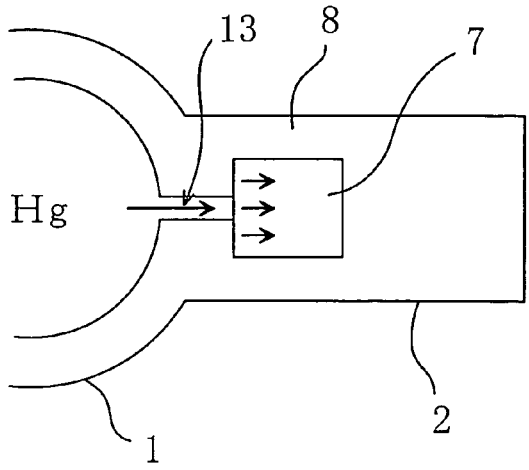
FIG. 23 is a schematic view for illustrating the mechanism by which compressive stress is generated in the second glass portion by mercury vapor.

FIG. 22 schematically shows the profile of this heating. First, heating is started (time O), and then the lamp temperature reaches the strain point ($T_2$) of the second glass portion 7 (time A). Then, the lamp is stored at a temperature between the strain point ($T_2$) of the second glass portion 7 and the strain point ($T_1$) of the first glass portion 8 for a predetermined period of time. This temperature range can basically be regarded as a range in which only the second glass portion 7 can be deformed. During this storage, as shown in a schematic view of FIG. 23, a compressive stress is generated in the second glass portion 7 by the mercury vapor pressure (e.g., 100 atm or more).

It seems that applying pressure to the second glass portion 7 by the mercury vapor pressure is the most effective approach to utilize the annealing treatment, but it can be inferred that if some force can be applied to the second glass portion 7, not only the mercury vapor pressure but also this force (e.g., pushing the external lead 5) can apply a compressive stress to the second glass portion 7 as long as the lamp is stored at a temperature range between $T_2$ and $T_1$ shown in FIG. 22.

Then, when heating is stopped, the lamp is cooled and the temperature of the second glass portion 7 becomes lower than the strain point ($T_2$) after time B. When the temperature becomes lower than the strain point ($T_2$), the compressive stress of the second glass portion 7 remains. In this embodiment, after the lamp is stored at 1030° C. for 150 hours, it is cooled (natural cooling). Thus, the compressive stress of the second glass portion 7 is applied and let to remain.

By the above-described mechanism, a compressive stress is generated by the mercury vapor pressure, so that the magnitude of the compressive stress depends on the mercury vapor pressure (in other words, the amount of mercury enclosed).

In general, lamps tend to be broken as the mercury amount is increased. However, if the sealing structure of this embodiment is used, the compressive stress is increased as the mercury amount is increased and the withstand pressure is improved. That is to say, with the structure of this embodiment, a higher withstand pressure structure can be realized as the mercury amount is increased. Therefore, stable operation at very high withstand pressure that cannot be realized by current techniques can be realized.

In the state of the lamp shown in FIG. 8, a long glass tube (a long Vycor glass tube) 70 shown in FIG. 9 may be used instead. The longer the glass tube 70 is, the worse the conductance of the side tube portion 2' becomes. Therefore, use of the getter 75 in the longer glass tube brings about a greater advantage. Moreover, there is a high possibility that more impurities adhere to a longer glass tube 70 than to a shorter glass tube 70, so that a large amount of impurity gas would be generated in the longer tube 70. Also in this respect, use of the getter 75 in the longer glass tube brings about a greater advantage. The glass tube 70 shown in FIG. 9 is formed to make one end thereof (that is, the end of the glass tube 70 opposite to the luminous bulb 1') small in inside diameter, and the glass tube 70 is fixed at one said end. The glass tube 70 may be fixed either so that the small diameter portion of the glass tube 70 supports the external lead 5, or so that with the pipe 80 set substantially perpendicular, the small diameter portion of the glass tube 70 is hung on corners of the metal foil (molybdenum foil) 4.

Figure 11:
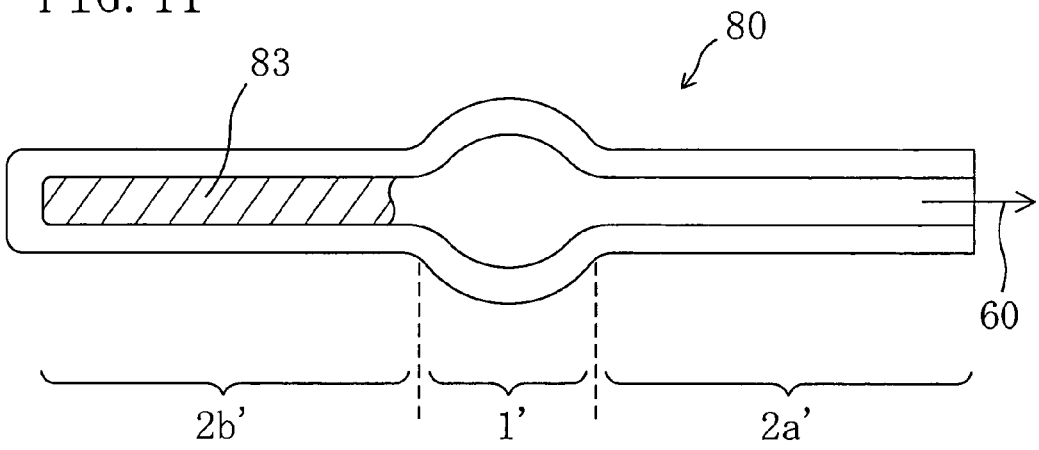
FIG. 11 is a schematic view showing the structure of the glass pipe 80.

The inventors studied the action of evacuation of the glass pipe 80 on the getter 75 and obtained the following consideration. It will be described with reference to FIG. 11. FIG. 11 shows the glass pipe 80 including the luminous bulb portion 1', a side tube portion **2*a*' whose end is open, and a side tube portion 2*b*' whose end is closed. The evacuation of a tube with a small diameter, that is to say, a thin tube is often attended with a very high resistance (in other words, a poor conductance), so that the thin tube (a glass tube) might be evacuated insufficiently even if a vacuum system reaches a high degree of vacuum. In particular, the glass pipe 80 has the luminous bulb portion 1' of substantially spherical shape in addition to the side tube portions 2' of cylindrical shape, so that the gas flow within the glass pipe 80 stagnates, which easily lets residual gas remain. Herein, the following possible phenomenon can be considered. In the example as shown in FIG. 11, gas (for example, air) is exhausted in the direction shown by the arrow 60 upon pushing a switch of a vacuum pump. Then, most of gas within the side tube portion 2*a*' shown in the right side of FIG. 11 is removed, while gas existing in a region 83 within the side tube portion 2*b*' shown in the left side of FIG. 11 is not exhausted smoothly. Thus, there would be a difference, which is usually unnoticable but has some magnitude, between the degree of vacuum indicated by the gauge of the vacuum system and the degree of vacuum in the glass pipe 80**.

In today's technology, there is demand for a lamp satisfying contradictory characteristics of long life and high output. Therefore, attention should be given to impurities which could conventionally be neglected (or which have never been considered), so that it is desirable that the residual gas existing in the region 83 be removed. It can be simply considered that it will suffice to change the vacuum system for a vacuum system with a higher degree of vacuum. However, this actually increases only the degree of vacuum indicated by the gauge of the system and probably does not increase the degree of vacuum in the pipe 80 to an expected extent. On the other hand, if the getter 75 is used, it absorbs the residual gas by its physical and chemical actions. Therefore, combination with the getter 75 has a greater effect on evacuation than use of the vacuum system alone. As described above, since the glass tube (the glass tube made of Vycor) 70 is additionally inserted into the side tube portion 2' in the production method of this embodiment, the evacuation in combination with the getter 75 has a huge advantage over the evacuation by the vacuum system alone.

Only if gas adsorbed on the getter 75 is emitted, the getter 75 can be used again and again. Therefore, it is possible to dismount the spent getter 75 in the stage shown in FIG. 5 and then to treat this getter 75 for reuse. The reusable getter 75 is advantageous for costs and for environment because no waste is created.

The getter 75 should not be placed in the luminous bulb portion 1' or the luminous bulb 1. This is because if the getter 75 having adsorbed impurities is present in the luminous bulb 1 of a completed lamp assembly, the impurities on the getter 75 reduce the life of the lamp. In the absence of the getter 75 in a completed lamp assembly (finished lamp), the lamp of this embodiment differs from an image display device of a PDP in which the getter stays present in an electron tube of a finished PDP.

(Second Embodiment)

Figure 12:
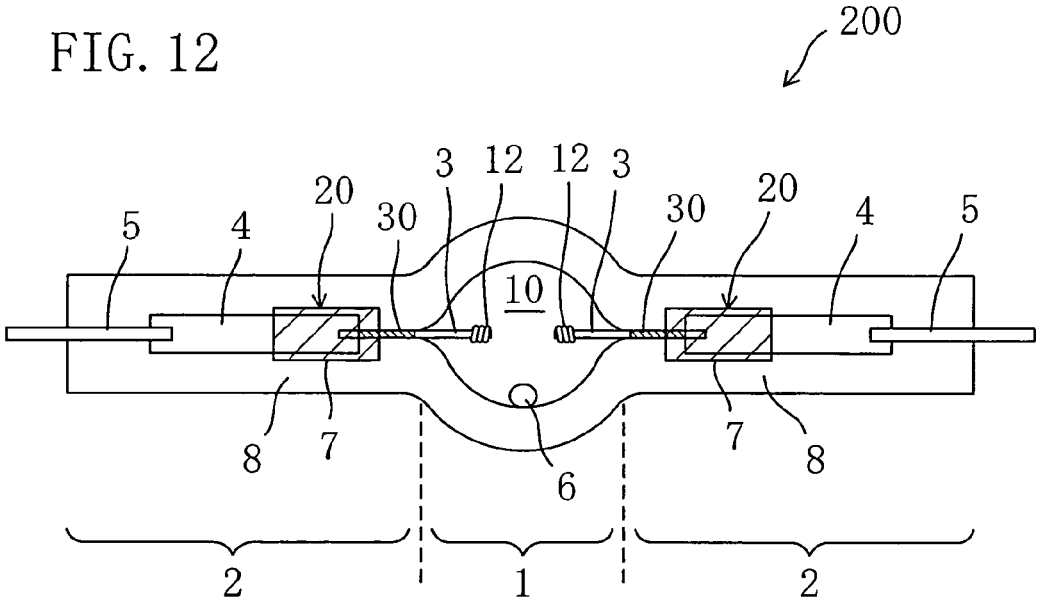
FIG. 12 is a schematic cross-sectional view showing the structure of a high pressure discharge lamp 200.

The structure of a high pressure discharge lamp produced by a production method thereof according to another embodiment of the present invention will be described with reference to FIG. 12. FIG. 12 is a schematic cross-sectional view showing the structure of a high pressure discharge lamp 200 of this embodiment.

In order to further improve the strength against pressure of the lamp 100 of the first embodiment, it is preferable to form a metal film (e.g., a Pt film) 30 on a surface of at least a portion of the electrode rod 3 that is buried in the sealing portion 2 like the lamp 200 shown in FIG. 12. It is sufficient that the metal film 30 is formed of at least one metal selected from the group consisting of Pt, Ir, Rh, Ru, and Re. The metal film 30 may be formed in a single layer made of a Pt layer, or the metal film 30 may be formed, in view of adhesion, in such a manner that the lower layer is an Au layer and the upper layer is, for example, a Pt layer.

In the lamp 200, the metal film 30 is formed on the surface of the portion of the electrode rod 3 that is buried in the sealing portion 2, and therefore small cracks are prevented from being generated in the glass positioned around the electrode rod 3. That is to say, in the lamp 200, in addition to the effects obtained by the lamp 100, the effect of preventing cracks can be obtained, and thus the strength against pressure can be improved further. The effect of preventing cracks will be described further below.

In the case of a lamp without the metal film 30 in the electrode rod 3 positioned in the sealing portion 2, in forming the sealing portion in a lamp production process, the glass of the sealing portion 2 and the electrode rod 3 are attached once, and then during cooling, the two components are detached because of the difference in the thermal expansion coefficient between the two components. In this case, cracks are generated in the quartz glass around the electrode rod 3. The presence of these cracks makes the strength against pressure lower than that of an ideal lamp without cracks.

In the case of the lamp 200 shown in FIG. 12, the metal film 30 having a Pt layer on its surface is formed on the surface of the electrode rod 3, so that the wettability between quartz glass of the sealing portion 2 and the surface (Pt layer) of the electrode rod 3 becomes poor. In other words, the wettability of a combination of platinum and quartz glass is poorer than that of a combination of tungsten and quartz glass, so that the two components are not attached and easily detached. As a result, the poor wettability between the electrode rod 3 and the quartz glass makes it easy to detach two components during cooling subsequent to the heating, which prevents small cracks from being generated. The lamp 200 produced based on the technical idea that generation of cracks are prevented by utilizing poor wettability as described above exhibits higher strength against pressure than the lamp 100.

Figure 13:
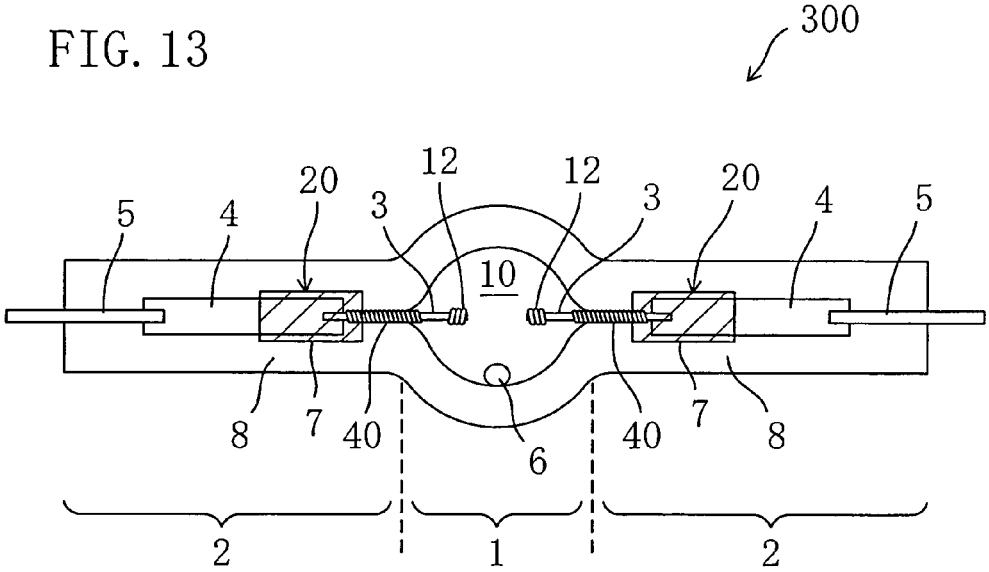
FIG. 13 is a schematic cross-sectional view showing the structure of a high pressure discharge lamp 300.

The structure of the lamp 200 shown in FIG. 12 can be replaced by the structure of a lamp 300 shown in FIG. 13. In the lamp 300, a coil 40 whose surface is coated with the metal film 30 is wound around the surface of the portion of the electrode rod 3 that is buried in the sealing portion 2 in the structure of the lamp 100 shown in FIG. 1. In other words, the lamp 300 has a structure in which the coil 40 having at least one metal selected from the group consisting of Pt, Ir, Rh, Ru, and Re at least on its surface is wound around the base of the electrode rod 3. In the structure shown in FIG. 13, the coil 40 is wound up to the portion of the electrode rod 3 that is positioned in the discharge space 10 of the luminous bulb 1. Also in the structure of the lamp 300 shown in FIG. 13, the wettability between the electrode rod 3 and the quartz glass can be made poor by the metal film 30 in the surface of the coil 40, so that small cracks can be prevented from being generated.

The metal on the surface of the coil 40 can be formed, for example, by plating. Like the structure of the lamp shown in FIG. 12, the metal film 30 may be formed in a single layer made of a Pt layer, or the metal film 30 may be formed, in view of adhesion, in such a manner that the lower layer is an Au layer and the upper layer is, for example, a Pt layer. It is preferable in view of attachment that an Au layer for the lower layer is first formed on the coil 40 and then, for example, a Pt layer for the upper layer is formed. However, even the coil 40 plated only with Pt without having the two layered structure of Pt (upper layer)/Au (lower layer) plating can provide practically sufficient attachment.

In the case of the structure in which at least one metal (referred to also as "Pt or the like") selected from the group consisting of Pt, Ir, Rh, Ru, and Re is provided on the surface of the electrode rod 3 or the surface of the coil 40, the significance of the second glass portion 7 being present around the metal foil 4 as in the structure of the embodiment of the present invention is very large. Further description of this point follows. A metal such as Pt can be evaporated to some extent by heating during processing in a lamp production process (sealing process). Therefore, if the evaporated metal is diffused to the metal foil 4, the attachment between the metal foil and the glass is weakened, which may degrade the withstand pressure. However, as in the structure of this embodiment, when the second glass portion 7 is provided around the metal foil 4 and a compressive strain is present there, then the poor wettability between Pt or the like and the glass is no more relevant. Consequently, degradation in withstand pressure caused by the diffusion of Pt or the like can be prevented.

It is to be noted that in the structures shown in FIGS. 12 and 13, a material in solid form (at ambient temperature) such as $HgBr_2$, not a material in gaseous form such as $CH_2Br_2$, is preferably used as the form of halogen to be enclosed (specifically halogen precursor). This is because a metal such as Pt may be etched by halogen in gaseous form.

Figure 10:
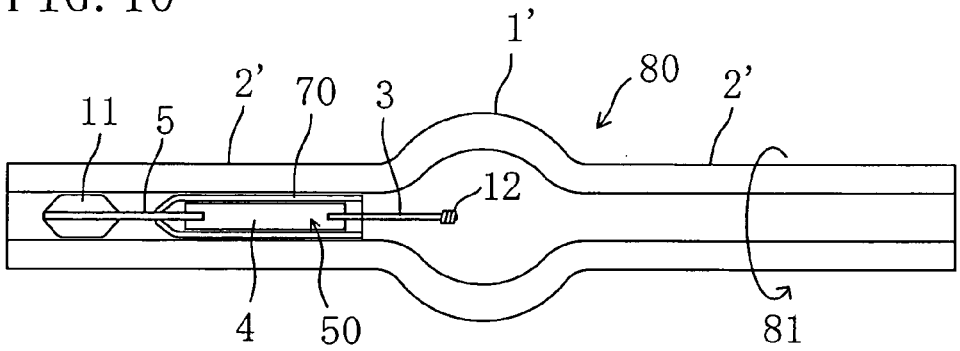
FIG. 10 is a cross-sectional view for explaining a process step of the method for producing the lamp 100.

Also in the lamps 200 and 300 according to this embodiment, as shown in FIG. 10, the second glass portion 7 covering the entire metal foil 4 may be formed from the glass tube 70 which covers the entire metal foil 4.

Furthermore, the lamps 100, 200 and 300 according to the embodiments of the present invention can be formed into a lamp with a mirror or a lamp unit in combination with a reflecting mirror.

Figure 14:
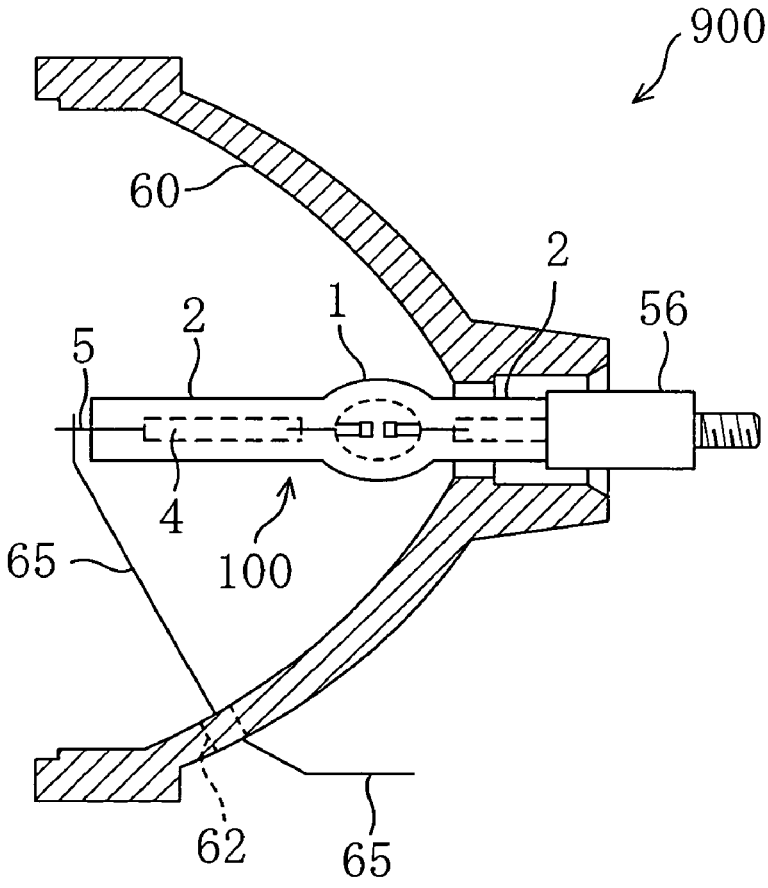
FIG. 14 is a schematic cross-sectional view showing the structure of a lamp 900 with a mirror.

FIG. 14 is a schematic cross-sectional view showing a lamp 900 with a mirror including the lamp 100 of this embodiment.

The lamp 900 with a mirror includes a lamp 100 having a substantially spherical luminous bulb 1 and a pair of sealing portions 2, and a reflecting mirror 60 for reflecting light emitted from the lamp 100. The lamp 100 is only an example, and the lamp 200 or the lamp 300 can be used as well. The lamp 900 with a mirror may further include a lamp housing for holding the reflecting mirror 60. The lamp with a mirror including a lamp housing is encompassed in a lamp unit.

The reflecting mirror 60 is configured to reflect radiated light from the lamp 100 such that the light becomes, for example, a parallel light flux, a condensed light flux converging a predetermined small region, or a divergent light flux equivalent to a light diverged from a predetermined small region. As the reflecting mirror 60, for example, a parabolic mirror or an ellipsoidal mirror can be used.

In this embodiment, a lamp base 56 is provided in one of the sealing portions 2 of the lamp 100, and the lamp base 56 and an external lead (5) extending from the sealing portion 2 are electrically connected to each other. The sealing portion 2 and the reflecting mirror 60 are attached tightly with, for example, an inorganic adherent (e.g., cement) so that they are integrated into one unit. An extending lead wire 65 is electrically connected to the external lead 5 of the sealing portion 2 positioned on the front opening side of the reflecting mirror 60, and the extending lead wire 65 is extended from the lead wire 5 to the outside of the reflecting mirror 60 through an opening 62 of the reflecting mirror 60 for drawing the lead wire. For example, a front glass can be attached in the front opening of the reflecting mirror 60.

Such a lamp with a mirror or a lamp unit can be attached to an image projecting apparatus such as a projector employing liquid crystal or DMD (Digital Micromirror Device), and can be used as a light source of an image projecting apparatus. Furthermore, an image projecting apparatus can be formed by combining such a lamp with a mirror or a lamp unit with an optical system including an image device (DMD panels or liquid crystal panels). For example, projectors (digital light processing (DLP) projectors) using DMDs or liquid crystal projectors (including reflective projectors using a LCOS (Liquid Crystal on Silicon) structure) can be provided. Furthermore, the lamp, the lamp with a mirror or the lamp unit of this embodiment can be used preferably not only as a light source of an image projecting apparatus but also for other applications such as a light source for an ultraviolet ray stepper, a light source for a sport stadium, a light source for an automobile headlight, and a floodlight for illuminating a traffic sign.

(Other Embodiments)

In the above embodiments, a mercury lamp using mercury as a luminous material has been described as one example of a high pressure discharge lamp, but the present invention can be applied to any high pressure discharge lamps having the structure in which the sealing portions (seal portions) maintain the airtightness of the luminous bulb. For example, the present invention can be applied to a high pressure discharge lamp such as a metal halide lamp enclosing a metal halide, or a xenon lamp. This is because also in metal halide lamps or the like, it is preferable that the increased withstand pressure is better. That is to say, a high reliable lamp having a long life can be realized by preventing leakage or cracks. Moreover, if the structure of this embodiment is applied to a metal halide lamp enclosing not only mercury but also a metal halide, the following effect can be obtained. The attachment of the metal foil 4 in the sealing portion 2 can be improved by providing the second glass portion 7, so that the reaction between the metal foil 4 and a metal halide (or halogen or an alkali metal) can be suppressed. Therefore, the reliability of the structure of the sealing portion can be improved. In particular, in the case where the second glass portion 7 is positioned in a portion of the metal rod 3 like the structure shown in FIGS. 1, 12 and 13, the second glass portion 7 can effectively reduce metal halide penetration which occurs from a small gap between the metal rod 3 and the glass of the sealing portion 2 and which causes embrittlement of the metal foil 4 due to the reaction of the foil with the metal halide. Thus, the structure of the above embodiment can be applied preferably to a metal halide lamp.

In recent years, a mercury-free metal halide lamp with no mercury enclosed has been under development, and the techniques of the above embodiments can be applied to a mercury-free metal halide lamp. This will be described in greater detail below.

An example of the mercury-free metal halide lamp to which the present invention is applied is a lamp having the structure shown in FIGS. 1, 12 and 13, but not substantially enclosing mercury and enclosing at least a first halide, a second halide and rare gas. The metal constituting the first halide is a luminous material. The second halide has a vapor pressure higher than that of the first halide and is a halide of one or more metals that emit light in a visible light region with more difficulty than the metal constituting the first halide. For example, the first halide is a halide of one or more metals selected from the group consisting of sodium, scandium, and rare earth metals. The second halide has a relatively larger vapor pressure and is a halide of one or more metals that emit light in a visible light region with more difficulty than the metal constituting the first halide. More specifically, the second halide is a halide of at least one metal selected from the group consisting of Mg (magnesium), Fe (iron), Co (cobalt), Cr (chromium), Zn (zinc), Ni (nickel), Mn (manganese), Al (aluminum), Sb (antimony), Be (beryllium), Re (rhenium), Ga (gallium), Ti (titanium), Zr (zirconium), and Hf (hafnium). The second halide containing at least Zn halide is more preferable.

Another combination example is as follows. In a mercury-free metal halide lamp including a translucent luminous bulb (airtight vessel) 1, a pair of electrodes 3 provided in the luminous bulb 1, and a pair of sealing portions 2 coupled to the luminous bulb 1, $ScI_3$ (scandium iodide) and NaI (sodium iodide) as luminous materials, $InI_3$ (indium iodide) and TlI (thallium iodide) as alternative materials to mercury, and rare gas (e.g., Xe gas at 1.4 MPa) as starting aid gas are enclosed in the luminous bulb 1. In this case, $ScI_3$ (scandium iodide) and NaI (sodium iodide) constitute the first halide, and $InI_3$ (indium iodide) and TlI (thallium iodide) constitutes the second halide. The second halide can be any halide as long as it has a comparatively high vapor pressure and can serve as an alternative to mercury. Therefore, for example, Zn iodide can be used instead of $InI_3$ (indium iodide).

The reason why the technique of the first embodiment can be applied preferably to such a mercury-free metal halide lamp will be described below.

First, the efficiency of a mercury-free metal halide lamp employing an alternative substance of Hg (for example, Zn halide) is lower than that of a lamp containing mercury. In order to increase the efficiency, it is very advantageous to increase the operating pressure for lamp operation. The lamp of the first embodiment has a structure that improves the withstand pressure, so that a rare gas can be enclosed to a high pressure. Therefore, the efficiency can be improved easily. Thus, a mercury-free metal halide lamp that can be put to practical use can be realized easily. In this case, Xe having a low thermal conductivity is preferable as the rare gas.

In the case of a mercury-free metal halide lamp, since mercury is not enclosed therein, it is necessary to enclose halogen in a larger amount than in the case of a metal halide lamp containing mercury. Therefore, the amount of halogen that reaches the metal foil 4 through a gap near the electrode rod 3 is increased, and the halogen reacts with the metal foil 4 (the base portion of the electrode rod 3 in some cases). As a result, the sealing portion structure becomes weak and leakage tends to occur. In the structures shown in FIGS. 12 and 13, the surface of the electrode rod 3 is coated with the metal film 30 (or the coil 40), so that the reaction between the electrode rod 3 and the halogen can be prevented effectively. As shown in FIG. 1, in the case of the structure in which the second glass portion 7 is positioned around the electrode rod 3, the second glass portion 7 can prevent the halide (e.g., Sc halide) from penetrating. Thus, it is possible to prevent leakage from occurring. Therefore, the mercury-free metal halide lamp having the above-described structure has a higher efficiency and a longer life than a conventional mercury-free metal halide lamp. This can be said widely for lamps for general illumination. For lamps for headlights of automobiles, the following advantage can be provided.

In the case of a headlight of an automobile, there is a demand that light of the headlight be fully provided at the moment when a switch of the headlight is turned on. In order to meet this demand, it is effective to enclose a rare gas (specifically, Xe) to a high pressure. However, if Xe is enclosed to a high pressure in a regular metal halide lamp, the possibility of breakage is high. This is not preferable as a lamp for a headlight for which higher safety is required. This is because the malfunction of a headlight at night leads to a car accident. The mercury-free metal halide lamp having the structure of the above embodiment has an improved withstand pressure, so that even if Xe is enclosed to a high pressure, the operation start properties can be improved with the safety ensured. In addition, it attains a long life, so that it is used more preferably for a headlight.

Furthermore, in the above embodiments, the case where the mercury vapor pressure of the lamp is about 20 MPa or 30 MPa or more (the case of a so-called ultrahigh pressure mercury lamp) has been described, but this does not eliminate the application of this embodiment to a high pressure mercury lamp having a mercury vapor pressure of about 1 MPa. The present invention can be applied to general high pressure discharge lamps including ultrahigh pressure mercury lamps and high pressure mercury lamps. It should be noted that the mercury vapor pressure of a lamp currently called an ultrahigh pressure mercury lamp is 15 MPa or more (the amount of mercury enclosed is 150 mg/cc or more).

The fact that stable operation can be achieved at a very high operating pressure means high reliability of the lamp. Therefore, when the structure of this embodiment is applied to a lamp having a not very high operating pressure (the operating pressure of the lamp is less than about 30 MPa, e.g., about 20 MPa to 1 MPa), the reliability of the lamp operating at that operating pressure can be improved.

A technical significance of a lamp that can realize a high strength against pressure will be further described below. In recent years, in order to obtain a high pressure mercury lamp of high output and high power, a short arc type mercury lamp having a short arc length (interelectrode distance) (e.g., the interelectrode distance is 2 mm or less) has been under development. In the case of the short arc type lamp, it is necessary to enclose a larger amount of mercury than usual in order to suppress a rapid evaporation of the electrode due to an increase of current. As described above, in the conventional structure, there was the upper limitation on the strength against pressure, so that there was also the upper limitation of the amount of mercury to be enclosed (e.g., about 200 mg/cc or less). Therefore, there was a limitation on the realization of the lamp exhibiting better characteristics. The lamp of this embodiment can eliminate such a conventionally existing limitation, and can promote the development of the lamp exhibiting excellent characteristics that could not be realized in the past. The lamp of this embodiment makes it possible to realize a lamp having an amount of mercury to be enclosed of more than about 200 mg/cc or about 300 mg/cc or more.

As described above, the technology that can realize an amount of mercury to be enclosed of about 300 to 400 mg/cc or more (operating pressure for lamp operation of 30 to 40 MPa) has a significance that the safety and reliability of lamps, especially lamps of a level exceeding the operating pressure for lamp operation of 20 MPa (that is, lamps having an operating pressure exceeding a currently-used pressure of 15 to 20 MPa, for example a lamp with an operating pressure of 23 MPa or more or 25 MPa or more) can be guaranteed. In the case of mass production of lamps, it is inevitable that there are variations in the characteristics of the lamps, so that it is necessary to ensure the withstand pressure with consideration for the margin even for a lamp having a light operating pressure of about 23 MPa. Therefore, the technology that can achieve a withstand pressure of 30 MPa or more also provides a large advantage to lamps having a withstand pressure of less than 30 MPa from the viewpoint that products can be actually supplied. If lamps that can operate at a withstand pressure of 23 MPa or even lower are produced using the technology that can achieve a withstand pressure of 30 MPa, the safety and the reliability thereof can be improved.

Therefore, the structure of this embodiment can also improve the lamp characteristics in terms of reliability. In the lamp of the above embodiment, the sealing portion 2 is produced by a shrinking technique, but it can be produced by a pinching technique. Also, a double ended type high pressure discharge lamp has been described, but the technique of the above embodiment can be applied to a single ended type discharge lamp. In the above embodiment, the second glass portion 7 is formed from the glass tube (70) made of, for example, Vycor, but it does not have to be formed from a glass tube. Not only a glass structure which covers all sides of the metal foil 4 but even a glass structure which is in contact with the metal foil 4 and which can let a compressive stress present in a portion of the sealing portion 2 can be contemplated as the second glass portion 7, and therefore the glass structure to be the second glass portion 7 does not have to be formed from a glass tube. For example, a glass structure that has a slit in a portion of the glass tube 70 and has a C shape can be used, and for example, carats (glass pieces or glass plates) made of Vycor can be disposed in contact with one side or both sides of the metal foil 4. Alternatively, for example, a glass fiber made of Vycor can be disposed to cover the circumference of the metal foil 4. However, when a structure from glass powder such as a structure of sintered glass material formed by compressing and sintering glass powder, is used instead of the glass structure, a compressive stress cannot be present in a portion of the sealing portion 2. Therefore, it is better not to use a structure from glass powder.

In addition, the distance (arc length) between the pair of electrodes 3 can be a distance of a short arc type or can be longer than that. The lamp of the above embodiment can be used as either of an alternating current operation type and a direct current operation type. Furthermore, the structures shown in the above embodiment and the modified examples can be used mutually. The sealing portion structure including the metal foil 4 has been described, but it is possible to apply the structure of the above embodiment to a sealing portion structure without a foil. Also in the sealing portion structure without a foil, it is important to increase the withstand pressure and the reliability. More specifically, one electrode rod (tungsten rod) 3 with no molybdenum 4 is used as the electrode structure 50. The second glass portion 7 is disposed at least in a portion of that electrode rod 3, and the first glass portion 8 is formed to cover the second glass portion 7 and the electrode rod 3. Thus, a sealing portion structure can be constructed. In the case of this structure, the external lead 5 can be formed of the electrode rod 3.

Figure 15:
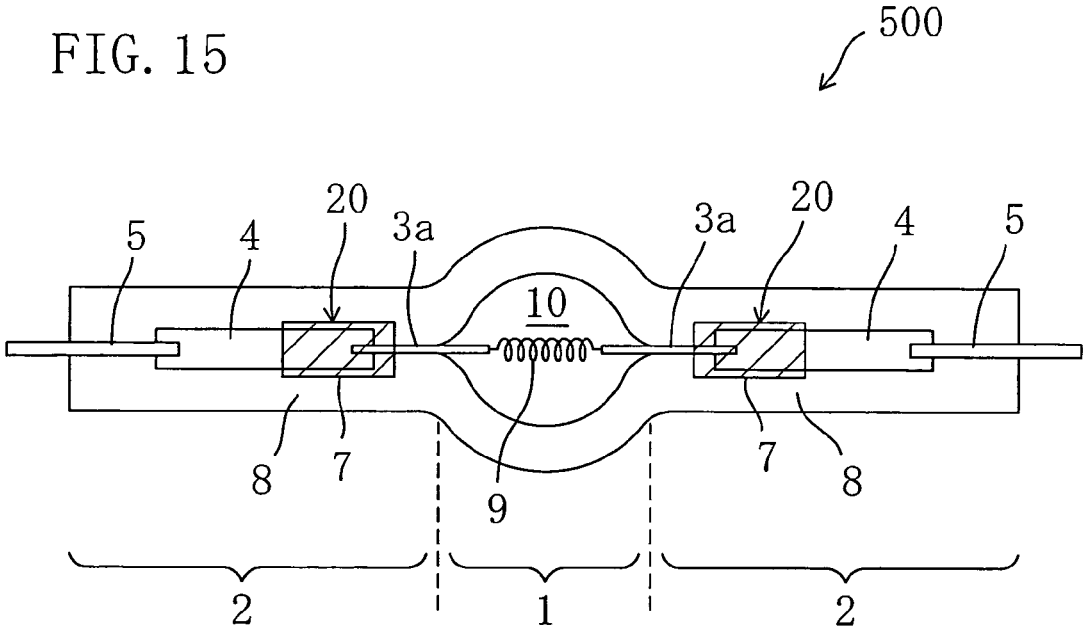
FIG. 15 is a schematic cross-sectional view showing the structure of a lamp 500.
Figure 16:
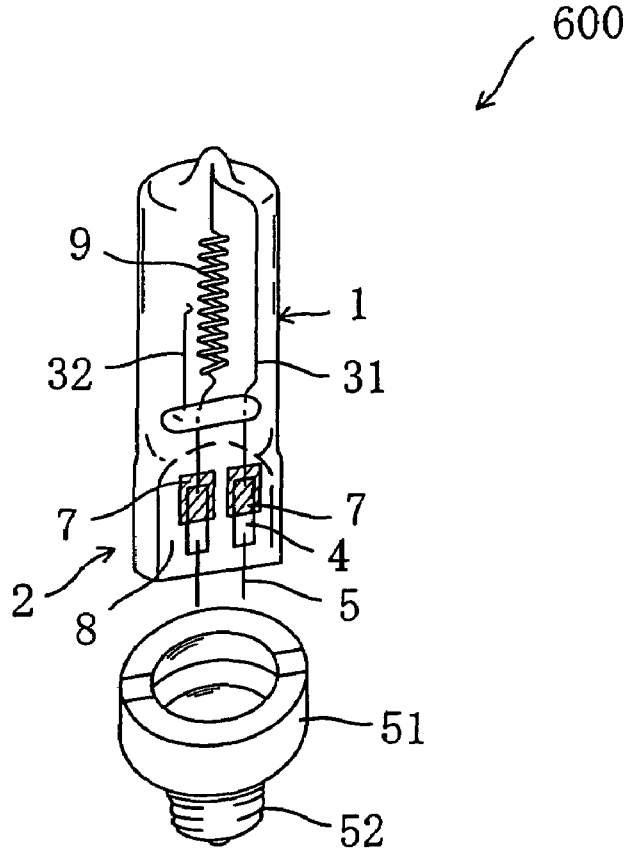
FIG. 16 is a perspective view schematically showing the structure of a lamp 600.
Figure 17:
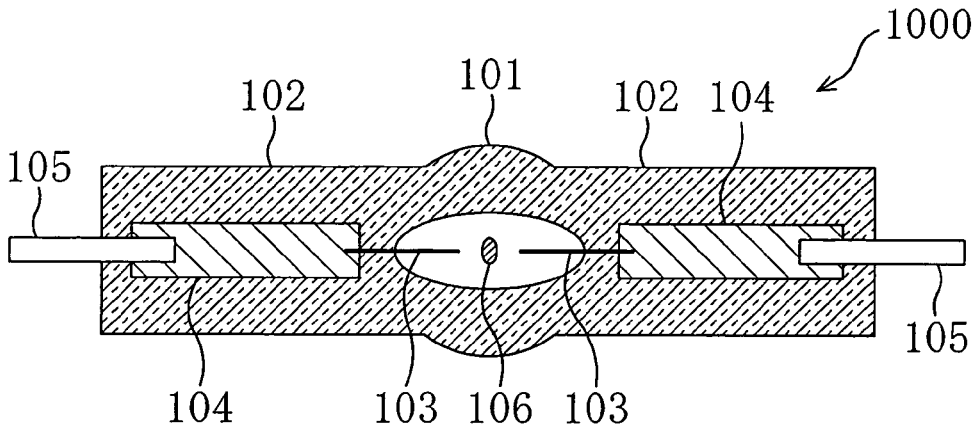
FIG. 17 PRIOR ART
FIG. 17 is a schematic cross-sectional view showing the structure of a conventional high pressure mercury lamp.

In the above-described embodiment, discharge lamps have been described, but the technique of the first embodiment is not limited to the discharge lamps, and can be applied to any lamps other than discharge lamps (e.g., incandescent lamps) as long as they can retain the airtightness of the luminous bulb by the sealing portions (seal portions). FIGS. 15 and 16 show incandescent lamps to which the technique of the first embodiment is applied.

An incandescent lamp 500 shown in FIG. 15 is a double ended type incandescent lamp (e.g., a halogen incandescent lamp) in which a filament 9 is provided in the luminous bulb 1. The filament 9 is connected to an inner lead (internal lead wire) 3*a*. An anchor can be provided in the luminous bulb 1.

An incandescent lamp 600 shown in FIG. 16 is a single ended type incandescent lamp, as seen from FIG. 16. In this example, a single ended type halogen incandescent lamp is shown. The incandescent lamp 600 includes, for example, a quartz glass globe 1, a sealing portion 2 (a first glass portion 8, a second glass portion 7, and a molybdenum foil 4), a filament 9, an inner lead 31, an anchor 32, an outer lead (external lead wire) 5, an insulator 51 and a lamp base 52. For such a halogen incandescent lamp as well, breakage is a very important issue to be addressed, so that the technique of the above-described embodiment that prevents breakage has a large technical significance.

The preferable embodiments have been described above, but the description above is not limiting, and various modifications can be made.

What is claimed is:

1. A method for producing a high pressure discharge lamp comprising a luminous bulb enclosing a luminous substance inside and a sealing portion for retaining the airtightness of the luminous bulb, the method comprising the steps of:

preparing a glass pipe for a discharge lamp including a luminous bulb portion that will be formed into a luminous bulb of a high pressure discharge lamp and a side tube portion extending from the luminous bulb portion;

inserting, into the side tube portion, a glass member made of a second glass having a softening point lower than that of a first glass constituting the side tube portion;

disposing a getter in the side tube portion; and heating the side tube portion with the pressure inside the glass pipe reduced to tightly attach the glass member to the side tube portion, thereby forming the sealing portion.

2. The method of claim 1, further comprising the step of heating, after the attachment step, a portion including at least the glass member and the side tube portion at a temperature higher than the strain point temperature of the second glass.

3. The method of claim 2, wherein the heating step is performed at a temperature lower than the strain point temperature of the first glass.

4. The method of claim 1, wherein the glass member is a glass tube or a glass plate formed of $SiO_2$ and at least one of 15 wt % or less of $Al_2O_3$ and 4 wt % or less of B.

5. The method of claim 1, wherein the high pressure discharge lamp is a high pressure mercury lamp, and the high pressure discharge lamp encloses, as the luminous substance, mercury in an amount of 150 mg/cm$^3$ or more based on the internal volume of the luminous bulb.

6. A method for producing a high pressure discharge lamp comprising a luminous bulb enclosing a luminous substance inside and a pair of sealing portions extending from both ends of the luminous bulb, the method comprising the steps of:

preparing a glass pipe for a discharge lamp including a luminous bulb portion that will be formed into a luminous bulb of a high pressure discharge lamp and a pair of side tube portions extending from both ends of the luminous bulb portion;

inserting, into one of the pair of side tube portions, a glass tube made of a second glass having a softening point lower than that of a first glass constituting the side tube portion and an electrode structure including at least an electrode rod, and then shrinking one said side tube portion by heating to form one of the pair of sealing portions;

introducing a luminous substance and halogen precursor to be decomposed into halogen into the luminous bulb portion after one said sealing portion is formed;

inserting a glass tube made of the second glass and an electrode structure including at least an electrode rod into the other of the pair of side tube portions;

disposing a getter in the other said side tube portion;

shrinking the other said side tube portion by heating with the pressure inside the glass pipe reduced to form the other of the pair of sealing portions; and heating a portion of a lamp assembly resulting from the formation of both the sealing portions and the luminous bulb at a temperature higher than the strain point temperature of the second glass and lower than the strain point temperature of the first glass, the portion of the lamp assembly including at least the glass tube and the side tube portion.

7. The method of claim 6, wherein the step of forming the other sealing portion includes the substep of cutting off and removing an unnecessary portion of the other said side tube portion after the other said side tube portion is shrunk by heating, and the unnecessary portion of the other said side tube portion contains the getter and the getter is removed when the unnecessary portion is cut and removed.

8. The method of claim 6, wherein the electrode structure includes the electrode rod, a metal foil connected to the electrode rod, and an external lead connected to the metal foil, a supporting member for supporting the electrode structure is connected to a portion of the external lead, when the glass tube and the electrode structure are inserted into one or the other said side tube portion, the electrode structure is disposed in one or the other said side tube portion so that the glass tube is placed around at least a portion of the electrode structure, and the head of the electrode rod of the electrode structure is disposed to be present in the luminous bulb portion, in the step of disposing a getter in the other said side tube portion, when the side of the other said side tube portion closer to the luminous bulb portion is assumed to be the front, the getter is disposed at the back of the supporting member of the electrode structure, the step of activating the getter by heating is performed during the time when the pressure inside the glass pipe is reduced, the step of forming the other sealing portion includes the substep of cutting off and removing an unnecessary portion of the other said side tube portion after the other said side tube portion is shrunk by heating, the unnecessary portion of the other said side tube portion contains the getter, and in the cutting and removing substep, the other said side tube portion is cut such that a portion of the external lead is cut off, thereby removing the getter.

9. The method of claim 6, wherein the halogen precursor is mercuric bromide ($HgBr_2$).

10. The method of claim 6, wherein the heating step is performed for 2 hours or more.

11. The method of claim 10, wherein the heating step is performed for 100 hours or more.

12. The method of claim 6, wherein the heating step is performed so that when the sealing portion is measured by a sensitive color plate method utilizing a photoelastic effect, a compressive stress of from 10 kgf/cm$^2$ to 50 kgf/cm$^2$ inclusive in the longitudinal direction of the side tube portion is present in a region of the sealing portion made of the second glass.

13. The method of claim 12, wherein the compressive stress is generated in each of the pair of sealing portions.

14. The method of claim 6, wherein the first glass contains 99 wt % or more of $SiO_2$, and the second glass contains $SiO_2$ and at least one of 15 wt % or less of $Al_2O_3$ and 4 wt % or less of B.

15. The method of claim 14, wherein the temperature of the heating is 1030° C.±40° C.

16. The method of claim 6, wherein the high pressure discharge lamp is a high pressure mercury lamp, and the high pressure discharge lamp encloses, as the luminous substance, mercury in an amount of 150 mg/cm$^3$ or more based on the internal volume of the luminous bulb.

* * * * *

UNITED STATES PATENT AND TRADEMARK OFFICE

CERTIFICATE OF CORRECTION

PATENT NO. : 7,097,529 B2
APPLICATION NO. : 10/744674
DATED : August 29, 2006
INVENTOR(S) : Makoto Horiuchi et al.

It is certified that error appears in the above-identified patent and that said Letters Patent is hereby corrected as shown below:

On Title Page
Item (56) References Cited, US 5,239,232, 8/1993, Heider et al. should be listed Col. 34, Line 5, Claim 15, "1030°C.±40°C" should be -- 1030°C±40°C -- (Delete ".")

Signed and Sealed this

Second Day of January, 2007

JON W. DUDAS
*Director of the United States Patent and Trademark Office*